US010008775B2

(12) United States Patent
Svendsen et al.

(10) Patent No.: US 10,008,775 B2
(45) Date of Patent: Jun. 26, 2018

(54) ANTENNA CONFIGURATION WITH A COUPLER ELEMENT FOR WIRELESS COMMUNICATION

(71) Applicant: Intel IP Corporation, Santa Clara, CA (US)

(72) Inventors: Simon Svendsen, Aalborg (DK); Ole Jagielski, Frederikshavn (DK); Boyan Yanakiev, Aalborg (DK); Finn Hausager, Aabybro (DK)

(73) Assignee: Intel IP Corporation, Santa Clara, CA (US)

( * ) Notice: Subject to any disclaimer, the term of this patent is extended or adjusted under 35 U.S.C. 154(b) by 616 days.

(21) Appl. No.: 14/318,754

(22) Filed: Jun. 30, 2014

(65) Prior Publication Data

US 2015/0380818 A1 Dec. 31, 2015

(51) Int. Cl.

| | |
|---|---|
| ***H01Q 1/24*** | (2006.01) |
| ***H01Q 5/307*** | (2015.01) |
| ***H01Q 21/30*** | (2006.01) |
| *H01Q 5/378* | (2015.01) |
| *H01Q 5/10* | (2015.01) |

(52) U.S. Cl.

CPC ..... *H01Q 5/307* (2015.01); *H01Q 1/243* (2013.01); *H01Q 21/30* (2013.01); *H01Q 5/10* (2015.01); *H01Q 5/378* (2015.01)

(58) Field of Classification Search

CPC ..... H01Q 5/378; H01Q 5/10; H01Q 5/307; H01Q 5/30; H01Q 5/385; H01Q 5/392; H01Q 1/24; H01Q 1/38; H01Q 1/44; H01Q 1/241; H01Q 1/243; H01Q 1/244; H01Q 5/49; H01Q 19/26; H01Q 19/32; H01Q 21/28

USPC ..... 343/702, 833

See application file for complete search history.

(56) References Cited

U.S. PATENT DOCUMENTS

| | | | | |
|---|---|---|---|---|
| 7,616,158 | B2 * | 11/2009 | Mak | H01Q 1/243 343/700 MS |
| 8,199,057 | B2 | 6/2012 | Ishizuka | |
| 8,547,283 | B2 | 10/2013 | Wong | |
| 9,634,404 | B1 * | 4/2017 | Rowson | H01Q 1/48 |

(Continued)

FOREIGN PATENT DOCUMENTS

WO 2011031668 A1 3/2011

OTHER PUBLICATIONS

The American Radio Relay League, Gerald (Jerry) Hall, (ISBN: 0-87259-206-5).*

The American Radio relay League (ARRL).*

*Primary Examiner* — Hoang Nguyen

*Assistant Examiner* — Awat Salih

(74) *Attorney, Agent, or Firm* — Eschweiler & Potashnik, LLC

(57) ABSTRACT

A first antenna element is indirectly coupled to communication signals via a coupler that is located within a same volume of a body. A second antenna element is proximate to and adjacent the first antenna element. The first antenna element is configured to operate in a first frequency range and the second antenna element is configured to operate within a subset of the first frequency range concurrent with or simultaneously to the first antenna element. The coupler can operate to couple multiple antenna elements operating at different frequencies within the same volume of the body.

17 Claims, 12 Drawing Sheets

(56) References Cited

U.S. PATENT DOCUMENTS

| | | | | |
|---|---|---|---|---|
| 2004/0046694 | A1* | 3/2004 | Chiang | H01Q 1/242 342/360 |
| 2004/0150568 | A1* | 8/2004 | Chiang | H01Q 1/24 343/702 |
| 2005/0280589 | A1* | 12/2005 | Chiang | H01Q 9/36 343/702 |
| 2006/0082514 | A1* | 4/2006 | Chiang | H01Q 19/06 343/794 |
| 2008/0258992 | A1* | 10/2008 | Tsai | H01Q 1/2266 343/853 |
| 2011/0032165 | A1* | 2/2011 | Heng | H01Q 7/005 343/745 |
| 2012/0154687 | A1* | 6/2012 | Yang | H01Q 1/2266 348/725 |
| 2012/0274538 | A1* | 11/2012 | Tsou | H01Q 1/243 343/876 |
| 2013/0241800 | A1* | 9/2013 | Schlub | H01Q 1/243 343/893 |
| 2013/0285866 | A1* | 10/2013 | Watanabe | H01Q 13/10 343/770 |
| 2014/0085164 | A1* | 3/2014 | Kashiwagi | H01Q 21/00 343/893 |
| 2014/0097994 | A1* | 4/2014 | Wong | H01Q 1/243 343/750 |
| 2014/0125541 | A1* | 5/2014 | Hong | H01Q 1/243 343/836 |
| 2015/0123874 | A1* | 5/2015 | Chan | H01Q 9/42 343/905 |
| 2016/0043467 | A1* | 2/2016 | Desclos | H01Q 5/328 343/745 |

* cited by examiner

ANTENNA CONFIGURATION WITH A COUPLER ELEMENT FOR WIRELESS COMMUNICATION

FIELD

The present disclosure is in the field of wireless communications, and more specifically, pertains to an antenna configuration with a coupler for wireless communications.

BACKGROUND

The number of antennas utilized in modern wireless devices (e.g. smartphones) are increasing in order to support new cellular bands between 600 MHz to 3800 MHz MIMO (Multiple-Input Multiple-Output), carrier aggregation, WLAN (wireless local area network), NFC (Near Field Communication), GPS (Global Positioning System), or other communications, for example, which poses a challenge due to the volume or space required for each antenna to achieve good performance. For example, the performance of antennas in mobile phones is (among others) related to the volume or space allocated and the physical placement in the mobile device or mobile phone. Increasing the allocated volume for the antenna can result in better antenna performance in terms of S11 (reflection coefficient) and radiated efficiency. The width of the display and batteries is often nearly as wide as the smartphone itself and the available volume for antennas at the circumference near these components is very limited and in many cases not usable for antennas as a result of coupled interference. Other components like the USB connector, the audio jack and different user control buttons, are normally also placed at the circumference, reducing the volume for the antenna even more. Therefore, it is desired to provide antenna modules with low space consumption and good performance for wireless communication devices.

DETAILED DESCRIPTION

Figure 1:
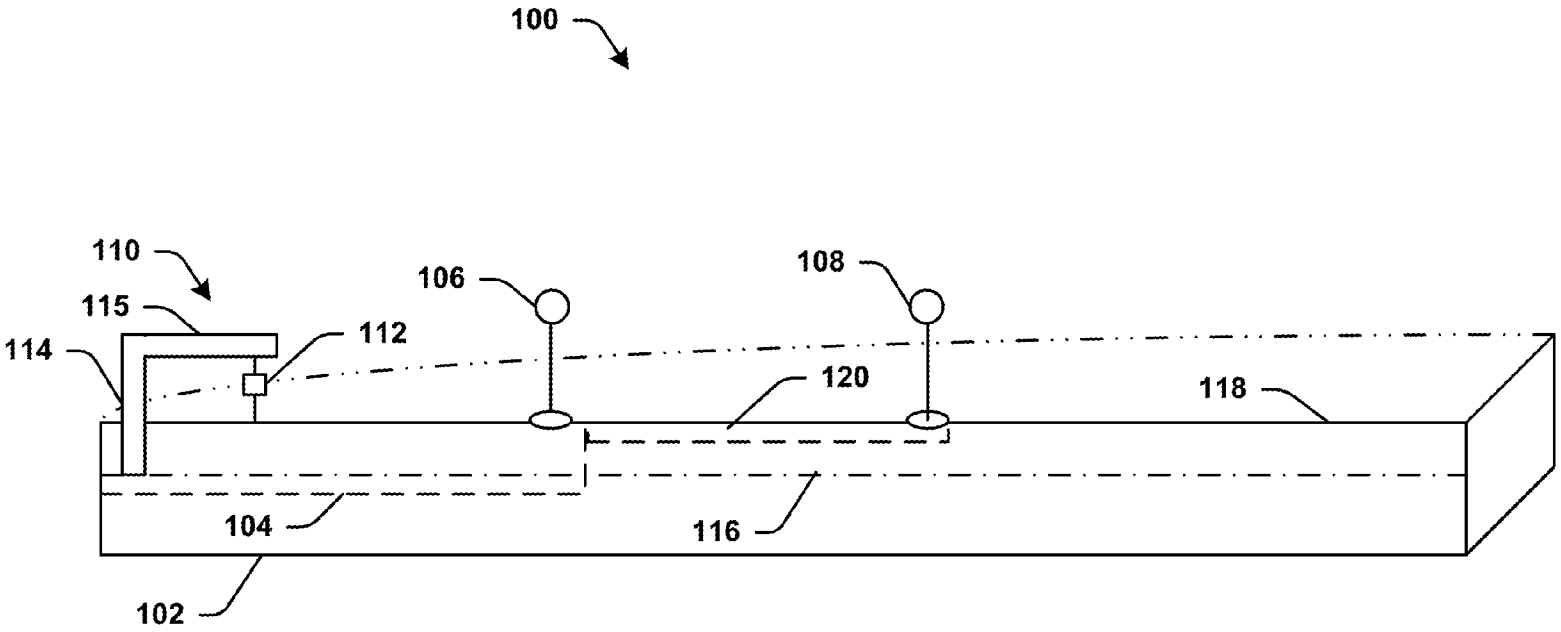
FIG. 1 is a block diagram illustrating an antenna system or device according to various aspects described.

The present disclosure will now be described with reference to the attached drawing figures, wherein like reference numerals are used to refer to like elements throughout, and wherein the illustrated structures and devices are not necessarily drawn to scale. As utilized herein, terms "component," "system," "interface," and the like are intended to refer to a computer-related entity, hardware, software (e.g., in execution), and/or firmware. For example, a component can be a processor, a process running on a processor, a controller, an object, an executable, a program, a storage device, and/or a computer with a processing device. By way of illustration, an application running on a server and the server can also be a component. One or more components can reside within a process, and a component can be localized on one computer and/or distributed between two or more computers. A set of elements or a set of other components can be described herein, in which the term "set" can be interpreted as "one or more."

Further, these components can execute from various computer readable storage media having various data structures stored thereon such as with a module, for example. The components can communicate via local and/or remote processes such as in accordance with a signal having one or more data packets (e.g., data from one component interacting with another component in a local system, distributed system, and/or across a network, such as, the Internet, a local area network, a wide area network, or similar network with other systems via the signal).

As another example, a component can be an apparatus with specific functionality provided by mechanical parts operated by electric or electronic circuitry, in which the electric or electronic circuitry can be operated by a software application or a firmware application executed by one or more processors. The one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components.

Use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form. Furthermore, to the extent that the terms "including", "includes", "having", "has", "with", or variants thereof are used in either the detailed description and the claims, such terms are intended to be inclusive in a manner similar to the term "comprising".

In consideration of the above described deficiencies of radio frequency communications, various aspects for wireless devices to utilize at least one of carrier aggregation, diversity reception, MIMO operations, NFC, GPS or various other communication operations with antenna architectures having a single coupler element are disclosed. Antenna performance can be compromised when bad isolation properties are present among antenna elements of an antenna system. Without good isolation, antenna elements of a system can couple to one another and thus reduce the power efficiency of one another. Isolation can be straightforward, if antenna elements of a system operate on different frequencies separated by a large frequency range of operation, or are separated from one another by a sufficient distance. The antenna systems disclosed can comprise a plurality of antenna components, antenna elements or antenna ports coupled to one or more antenna components that resonant at a respective frequency within frequency ranges that at least partially overlap or match. The antenna architectures disclosed can comprise solutions for having a high band cellular antenna next to a WLAN antenna with at least a portion of the operating frequency ranges overlapping or comprising a matching frequency range, for example.

By providing for an indirect coupler to multiple cellular high band antenna elements resonating at different frequencies within the cellular high band, a WLAN antenna element is able to be placed next to a cellular high band antenna element with at least a partially overlapping or matching operational frequency range with good isolation properties. In an aspect, a first antenna element can be located within a first antenna volume of a body that comprises a circuit board and a ground plane. The antenna element can be a cellular high band antenna, for example, that can operate or resonate at a resonant frequency within a first resonant frequency range, such as about 1710 MHz to about 2690 MHz. A second antenna element can be located within a second antenna volume of the body that is proximate to, neighboring, or adjacent to (touching and next to) the first antenna volume and the first antenna element. The second antenna element can be configured to operate at a second resonant frequency range that is a subset of the first resonant frequency range, such as about 2400 MHz to about 2484 MHz. Communication frequencies and frequency ranges can vary herein and can be within different ranges, for example, such as from about 704 MHz to 2960 MHz. For example, alternatively, the second antenna element can resonate in a cellular low band network antenna frequency range of about 704 MHz to about 960 MHz while the first antenna element operates within about 1710 MHz to about 2690 MHz.

An indirect coupler can be located within the first antenna volume and configured to indirectly (electromagnetically) couple the first antenna element to a feed signal component and a communication component (e.g., receiver, transmitter, transceiver or the like) for transmitting and receiving communications associated with the first antenna element. In one aspect, both the first antenna element and the second antenna element can be indirectly coupled via an electromagnetic coupling to the feed signal component and the communication component. The coupler can be inductively or capacitively coupled to the first antenna element and directly connected to a signal feed. The signal feed can be coupled to a transmitter, receiver, transceiver or the like communication component. In response to the coupler receiving a signal from a communication component via the signal feed, the coupler facilitates an indirect (electromagnetic) coupling with the antenna element, which provides an antenna system with an improved bandwidth.

In another aspect, a third antenna element can also be located within the first antenna volume and configured to operate at a third resonant frequency range that is a subset of and overlaps at least a part of the first frequency range. For example, the third antenna element can be a cellular high band antenna element that is also located in the first antenna volume, which can operate at a frequency within a range of about 2500 MHz to about 2690 MHz. The first antenna volume and the second antenna volume can reside in a circuit body, such as in a mobile device, in which both can be adjacent to one another and traverse a circumferential or a perimeter edge of the device. The coupler can be configured to indirectly couple communications via an electromagnetic coupling to a feed signal component and a communication component with the first antenna element and the third antenna element, which resonate at different frequencies from one another. Additional aspects and details of the disclosure are further described below with reference to figures.

FIG. 1 illustrates an example of an antenna system for wireless or antenna solutions to enable various different resonant elements or antenna components to operate at different frequency ranges close to one another with a single coupler element. The system 100 can include a communication system that operates in a device such as a wireless device or among one or more devices for communicating with one or more of carrier aggregation, diversity reception or MIMO operations, for example. The system 100 can facilitate the operation of multiple antennas having overlapping frequency ranges within a same edge, a same volume, a same quadrant, a same zone, a same portion or the like section of a device body such as a circuit board or a ground plane of a wireless device. The edge, volume, quadrant, zone, portion or like section of the device can be delineated and reside among multiple volumes, quadrants, zones, portions or like sections comprising a total volume of the device. For example, an antenna element that operates in one frequency range (e.g., a high frequency range of about 1710 MHz to about 2690 MHz) can be fabricated next to another antenna element or component that operates in a subset range of the same frequency range within a same volume or an adjacent portion of the device, or in a different frequency range than the first frequency range, such as in a different subset of the first frequency range or in a different range. The antenna element can be a cellular high band antenna element, for example, that is operational for cellular communications at a range of about 1710 MHz to about 2690 MHz via a single coupler within the volume, which electromagnetically couples the antenna element. The volume or volumes that the two antenna elements are fabricated within, or on, can be at, or reside along, a circumference portion or a single edge of the device, for example. The volume or volumes of the at least two antenna elements can comprise a fraction of the device volume such as by contacting less than all circumferential or perimeter edges of the device (e.g., about three or four dimensional edges).

The system 100 comprises a body 102, a first antenna volume 104, a first antenna port 106, a second antenna port 108, and a coupler 110. The body 102 can comprise a circuit board 102 with a ground plane 116. The body 102 can include a silicon body or other materials or metals that comprise at least a portion of a mobile or wireless device. The ground plane 116 can be fabricated at least partially within, below or above the body 102 of the circuit board and be the same shape or a different shape than the body 102. The first and second antenna ports 106 and 108 can operate as ports, connection points, or unions to one or more antenna components that can operate as resonant elements for wireless communications. The first and second antenna ports 106 and 108 can be coupled to the ground plane 116 of the body 102, or the circuit board, and correspond to or be designated to resonate for particular frequencies ranges for various mobile communications of different networks. For example, the first antenna port 106 can be designated for a cellular high band frequency network and operate within a high frequency bandwidth for communications via a cellular high band frequency network device associated with a cellular network. Likewise, the second antenna port 108 can be designated to resonate for a Wi-Fi network, or other network, and operate for communications within the network that can be associated with a WLAN network device or a different network device (e.g., Micro network device, Pico cell network device, etc.). The second antenna port 108, for example, is operable to facilitate communications in a frequency range that overlaps the frequency range of the first antenna port 106 and antenna components coupled thereto for communications within the WLAN network that are concurrent with or simultaneously to communications of the first antenna port 106. Alternatively, the second antenna port or the first antenna port can be coupled to a cellular low band network antenna element and operate in frequency ranges comprising about 704 MHz to about 960 MHz.

The first antenna port 106 and the second antenna port 108 can be located proximate to and adjacent one another along a same edge or perimeter of a mobile device. For example, the first antenna port 106 and the second antenna port 108 can be located adjacent to one another on a same edge 118 of a device body within a first half of the edge 118 or some other portion of a sectional volume along the edge of a mobile or wireless device. Other antenna configurations can also be envisioned according to one of ordinary skill the art, in which the first antenna port 106 and the second antenna port 108 are located next to one another in a section, portion or subset of the body 102 or a circuit board of the body 102, as well as with one or more antenna components coupled to antenna elements within a corresponding volume.

The first volume 104 and a second volume 120, for example, can respectively reside in and comprise a portion of the body 102. Alternatively, the first volume 104 and the second volume 120 can be the same volume within a subset, portion, quadrant or fractioned space of the body 102. The first volume 104 can comprise the coupler component 110 and the first antenna port 106 residing therein, as well as other antenna components associated with communications via the antenna port 106. The first volume 104 can reside next to, proximate to, nearby or adjacent to the second volume 120. Both the first volume 104 and the second volume 120 can be located adjacent to one another along the same edge 118 or same dimension of the body 102, such as along a same circumference or perimeter dimension of the device, which can be a subset of a volume that is less than an entire volume of the device. Components within the first volume 104 and the second volume 120 operate in conjunction within one another to facilitate communications within the same range of frequencies without having parasitic coupling effects that deter communications over one or both of the antenna port 106 and the antenna port 108 at the same time, concurrently, or simultaneously, for example. In one aspect, this can be facilitated by providing a single coupler element that can operate to match an impedance of the first antenna element while indirectly and electromagnetically (capacitively or inductively) coupling communications from a communication component.

The first volume 104 can further include the coupler 110 that can operate to indirectly couple one or more antenna components (e.g., a cellular high band antenna coupled to the first antenna port 106 and a cellular low band antenna or Wi-Fi antenna coupled to the second antenna port 108), which can operate to resonate at different frequencies via the antenna port 106 or other ports, for example. The coupler 110 can also be spaced adjacent to the antenna port 106 and within the same volume 104 of the circuit board, such as along the same edge 118 or section of a perimeter dimension as the first antenna port 106 and the second antenna port 108, for example. The coupler 110 is directly coupled to a feed element 112 that can include a circuit matching element or component. The coupler 110 can further be tuned or re-tuned to affect the coupling of an antenna element at first antenna port 106 by modification of the physical shape of the coupler element. The feed element 112 can operate to improve matching between a transceiver, receiver, transmitter or like communication component (not shown), and can be coupled to a transmitter, transceiver, receiver or other communication component (not shown) that operates to transmit or receive one or more communication signals (e.g., radio frequency signals) within a frequency range. The feed element 112 can provide the input for signals between the antenna port 106, or an antenna element coupled to the antenna port 106 and a communication component (e.g., a receiver, transmitter, transceiver, or the like component) for transmitting and receiving communication signals.

The coupler 110 can comprise a support structure 114 and an arm 115. The support structure can reside along the same edge 118 and be configured to support the arm 115 facing inward along the same edge 118 and towards the first antenna port 106 or in other orientations, for example. The coupler 110 operates to provide a desired electromagnetic coupling between the ground plane 116 and an antenna element of the antenna port 106.

The feed element 112 can be in electrical communication with a communication component (e.g., an antenna element, a transceiver, a receiver, transmitter or the like) and generally extend from the body 102 to the coupler 110. The feed element 112 can be formed from any suitable conductive element. In particular, a direct connection is not provided between the feed element 112 and the antenna port 106 or antenna components of the port 106 when signals are transmitted or received thereat. Rather, the feed element 112 is configured to receive one or more signals from a transceiver or other communication component and further operates to provide signals received to the coupler 110, which forms an indirect inductive or capacitive coupling with the an antenna element, for example, at the antenna port 106 by indirectly coupling the feed element 112 and a communication component (e.g., receiver, transceiver, transmitter or the like) to an antenna element (now shown) at the first antenna port 106.

The indirect coupler 110 is electromagnetically coupled to the antenna port 106 or antenna components thereat, and thus allows the energy transmitted to the coupler 110 to be provided indirectly to the antenna port 106, which can then resonant or communicate the signals in turn according to one or more antenna components. Further, in one embodiment, the indirect coupler 110 can also electromagnetically couple the second antenna port in response to an antenna being coupled thereat, so that one antenna coupler 110 operates to couple multiple different antenna elements that operate at different frequency ranges. The performance of the communicating can be affected by a capacitive or inductive coupling, for example, between the ground plane 116 and both the coupler 110 and antenna components at the antenna port 106. Likewise, when signals are being received by the antenna port 106 and/or 108, the signals are then provided to the transceiver or other communication component via the coupler 110 through electromagnetic coupling as provided by the support arm 114. The coupler 110 therefore enables an indirect (electromagnetic) coupling of signals being communicated to or from the antenna port 106 and/or 108 for transmitting and receiving communications with a communication component (receiver, transmitter, transceiver or like device) at one or more resonant frequencies. In further examples discussed below, a direct coupling can be defined as a direct connection between a communication component (e.g., receiver, transmitter, transceiver or the like) and the antenna port or the antenna element coupled thereto.

Figure 2:
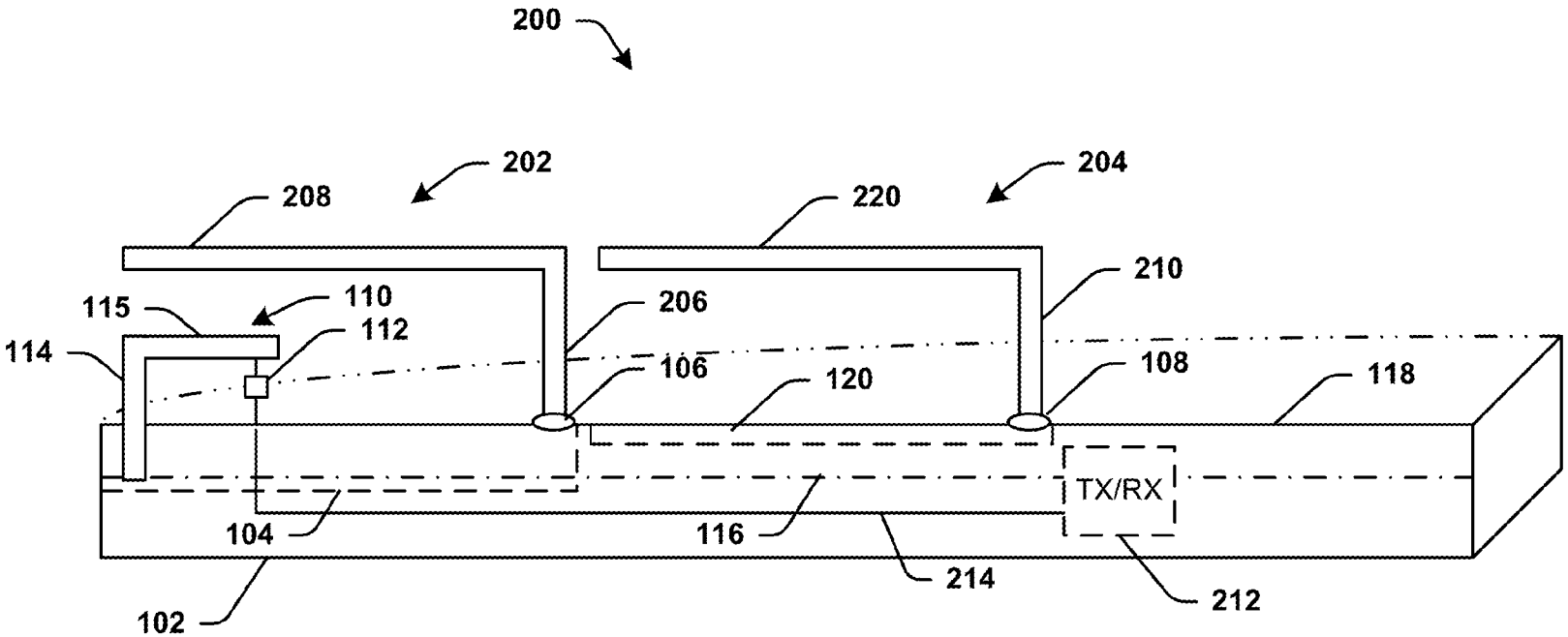
FIG. 2 is a block diagram illustrating a system for an antenna device according to various aspects described.

Referring now to FIG. 2, illustrated is a system for communicating one or more signals with different antennas of differing networks and in different frequency ranges via a single coupler or a coupler element among adjacent volumes or spaces of a device. The system 200 is similar to the system discussed above and further comprises a first antenna component or element 202 and a second antenna component or element 204 coupled to the first antenna port 106 and the second antenna port 108 respectively and operate as resonant elements for communications within a same or overlapping operational resonant frequency range.

The body 102 can be the body of a mobile or wireless device that further comprises a communication component 212, which can be a transmitter, a receiver, a transceiver, or other communication device that communicates different signals and processes them with antenna elements via the different antenna ports. The communication component 212, for example, can be directly coupled to the second antenna element 204 via a conductive path or the indirect coupler 110, and can be coupled to the first antenna element 202 indirectly via the feed 112 and the coupler 110. The communication component 212 can be coupled to the antenna element 204 and the antenna element 202 for processing communications simultaneously or concurrently.

The coupler 110 can be a single coupled element that indirectly (electromagnetically) couples signals from the feed component 112 and the communication component 212 with the first antenna element 202. The coupler 110 can be a single coupler element from among or residing within the first volume 104. Alternatively or additionally, the coupler 110 can be the only coupler element that couples communications with the first antenna element 202, for example, and can couple communications via an electromagnetic coupling with multiple antenna elements resonating at different frequencies within the same volume.

In one aspect, the second antenna element 204 can be directly coupled, or have a direct coupling to the communication component 212 through the second antenna port 108 and a conductive path 216, such that communications are received and transmitted from the communication component 212 in a direct connection via a direct conductive path to the communication component 212. Alternatively, the second antenna element 204 can be indirectly coupled to the communication component 212 with a feed and the coupler 110 via the antenna port 108 and be configured similarly as the first antenna element 202, with the coupler 110, the feed 112, and the conductive path 214.

As discussed above, the space or volume for good antenna performance within an antenna system or a device such as a modern smartphone can be limited, and the antenna systems disclosed, such as the antenna system 200 can provide an advantage of enabling the antennas to be placed physically right next to each other and be electrically isolated even though the first antenna element 202 and the second antenna element 204 operate with overlapping frequency ranges by being matched at least at a subset (e.g., approximately 2400 MHz to 2484 MHz) of at least one of those frequency ranges. Isolation and separation can be less of an issue if the first antenna element 202 and the second antenna element 204 operated on different frequencies separated by a large frequency range, such as, for example, a cellular low band antenna (704 MHz to 960 MHz) and a cellular high band antenna (operational in a range of about 1710 MHz to 2690 MHz). These two antennas can thus be separated by a relatively large frequency span (about 1 GHz) and can be placed right next to each other to still obtain a naturally good isolation. On the other hand, placing a WLAN antenna (2400 MHz to 2484 MHz) next to the cellular high band antenna (operational in a range of about 1710 MHz to 2690 MHz), for example, in which the frequencies are well matched or overlap can result in a naturally low isolation, since both antennas are matched at the 2400 MHz to 2484 MHz. A traditional single element cellular high band antenna with a single or dual order impedance match can be relatively well matched with the WLAN antenna at 2400 MHz to 2484 MHz due to the nature of the antenna, even though the WLAN frequency range does not have to be covered by the cellular high band antenna. The WLAN antenna can couple to the high band cellular antenna and some of the power can be lost in the cellular high band antenna, thereby reducing the efficiency of the WLAN antenna. Although particular bandwidths and operational ranges of frequencies are disclosed herein for example, other frequency ranges and antenna types are envisioned as having potentially different or overlapping resonating frequencies and are also a part of this disclosure.

In one aspect, the first antenna element 202 can comprise a first support structure 206 and an extending arm or other surface part 208. The first antenna element 202 can comprise a high band cellular antenna that operates with a frequency in a range of about 1710 MHz to 2690 MHz, for example. The first antenna element 202, in one example, can extend along the first volume 104 and in a substantially opposing direction to the arm 115 of the coupler 110, for example.

The second antenna element 204 can also comprise a support structure 210 and an extending surface or arm 220. The second antenna element 204 can comprise WLAN antenna element for communicating in a Wireless or Wi-Fi network and resonating at frequencies in a range of about 2400 MHz to 2484 MHz, or within a cellular low band frequency range. In one example, the second antenna element 204 can face in a same direction, along the same edge 118 and next to the first antenna element 202, even though both antenna elements are at least partially matched in operating frequencies.

The coupler 110 is configured to operate as one antenna coupler to indirectly couple to one or more antenna elements resonating at different frequencies in the same volume, such as the antenna elements 202 and 204. The first antenna element 202 can be a cellular high band antenna, which can be configured to operate in different frequencies within a range of about 1710 MHz to 2690 MHz (e.g., 1710 MHz to 2170 MHz, 2500 MHz to 2690 MHz, or the like) and placed right next to a WLAN antenna radiating in a frequency range of at least at 2400 MHz to 2484 MHz on a mobile device. In addition, the WLAN antenna can also radiate at other frequency ranges such as at about 5.6 GHz, for example.

In another aspect, the antenna system 200 is optimized for cellular high band operation from 1710 MHz to 2690 MHz, with a printed circuit board (PCB) cut back of about 7 mm and an antenna element length of about 21 mm. The PCB cut back can be kept at about 7 mm for the WLAN 2.4 GHz antenna element, with a length of 12 mm. The distance between the tip of the WLAN antenna and the cellular high band antenna can be about 2 mm, for example.

Figure 3:
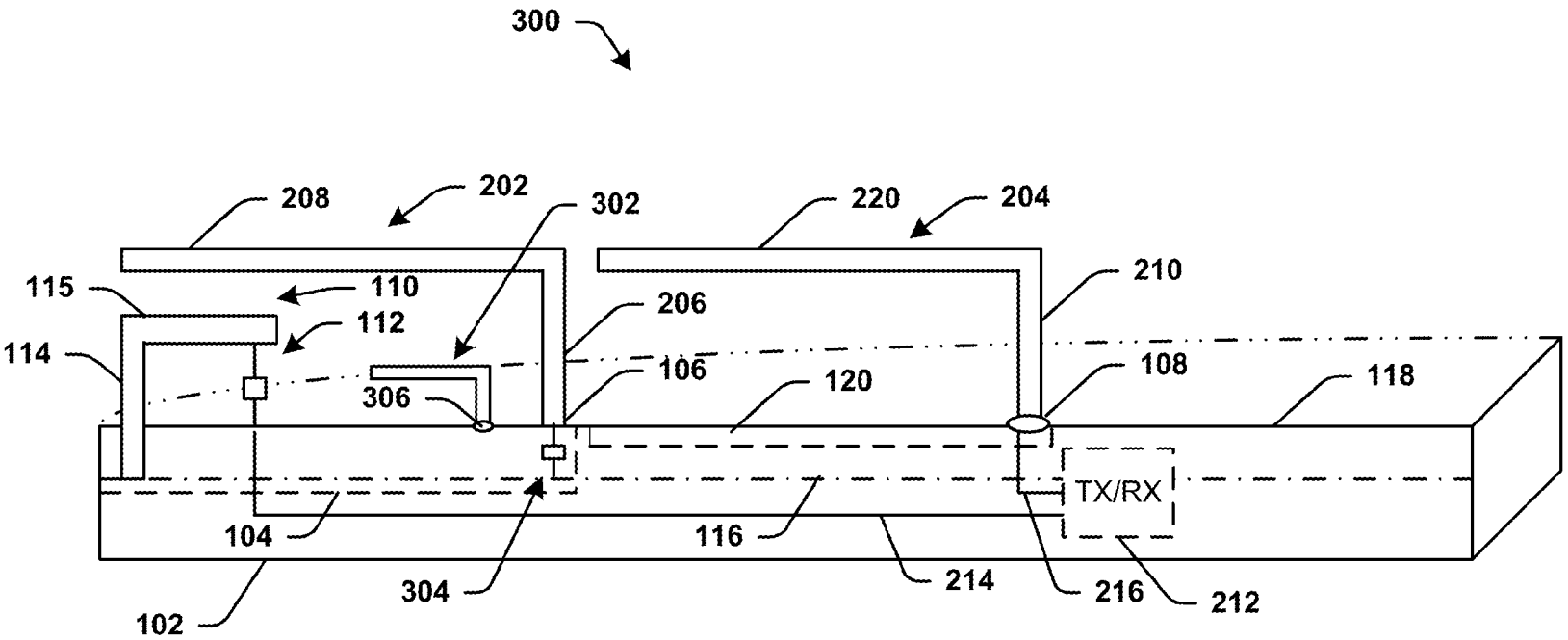
FIG. 3 is a block diagram of an antenna device according to various aspects described.

Referring now to FIG. 3, illustrated is an antenna system 300 in accord with various aspects described. The system 300 is similar to the systems discussed above and further includes a third antenna element 302 that operates in conjunction with the first antenna element 202 and the second antenna element 204 for optimizing isolation while maintaining good matching among the three antenna elements in the same volume at cellular high band frequencies. For example, the system 300 is configured to operate with improved isolation between the different antenna components of the first volume 104 in a mobile device or the body 102.

The third antenna element 302, for example, can reside within the first volume 104 via a third antenna port 306, along with the coupler 110 and the first antenna element 202, to operate in a subset frequency range of approximately 2500 MHz to 2690 MHz within the cellular high band frequency range of approximately 1710 MHz to 2690 MHz. Concurrently or simultaneously, the resonance of the first antenna element 202 can be configured, tuned or re-tuned to cover a lower part of the cellular high band frequency such as about 1710 MHz to 2170 MHz by a tuning component 304, such as an inductor or other component, which can be modified to alter the frequency range of the first antenna element 202 to encompass a lower subset of the cellular high band frequency range via a connection to the ground plane 116. The tuning component 304 can be configured as a predefined component with an inductance that alters the resonant frequency of the first antenna element 202. Alternatively, the tuning component 304 can configured to dynamically alter or modify an inductance or other electrical connection to the ground plane 116. The modification of the resonance frequency of the first antenna element 202 can thus be dynamic based on network parameters and altering network conditions or statically predetermined by the tuning component 304.

The tuning component 304 can operate by modifying the resonance of the first antenna element 202 within the volume 104 without a physical modification of the antenna element 202 or the volume space 104. Alternatively or additionally, a physical modification of the antenna element 202, such as by changing a length of the extending arm 208 can also operate to modify the resonant frequency range that the first antenna element 202 operates. Therefore, the resonance of the first antenna element 202 and the third antenna element 302 facilitates movement of, or a pushing of, the impedance at the frequency range of a WLAN antenna to the impedance edges of a Smith Chart, and thus obtain an improved isolation from the other antenna elements, while also maintaining matching characteristics at the cellular high band frequencies.

In an aspect, the coupler 110 can indirectly (capacitively or inductively) couple to different antenna elements (e.g., the first antenna element 202, the second antenna element 204, and/or the third antenna element 302) of the same volume 104 that have different resonating frequencies within different resonating frequency ranges respectively, such as about 1710 MHz to 2170 and 2500 MHz to 2690 MHz, for example. The coupler 110 can be configured to operate to tune the first antenna element 202 to resonate at a frequency range, and the tuning component 304 can operate to re-tune the first antenna component 202 to operate within the lower range of the cellular high band frequency range that it is capable of operating within. For example, the third antenna component 302 can thus operate to cover a subset of the cellular high band from about 2500 MHz to about 2690 MHz while the first antenna component 202 simultaneously operates within the same volume to cover a lower subset of the cellular high band frequencies such as within about 1710 MHz to about 2170 MHz, for example. At the same time the second antenna element 204 can also operate within a range of about 2170 MHz to 2400 MHz for wireless networks, for example. The coupler 110 thus operates to indirectly electromagnetically couple the first antenna element 202, the second antenna element and/or the third antenna element 302 operating at different frequencies within a same volume 104 or portion of the body 110.

Referring now to FIGS. 4-9, illustrated are examples of diagrams of the impedance and isolation effects of the antenna elements 202, 204 and the coupler 110, without the third antenna element 302 and with the third antenna element 302 for comparison.

Figure 4:
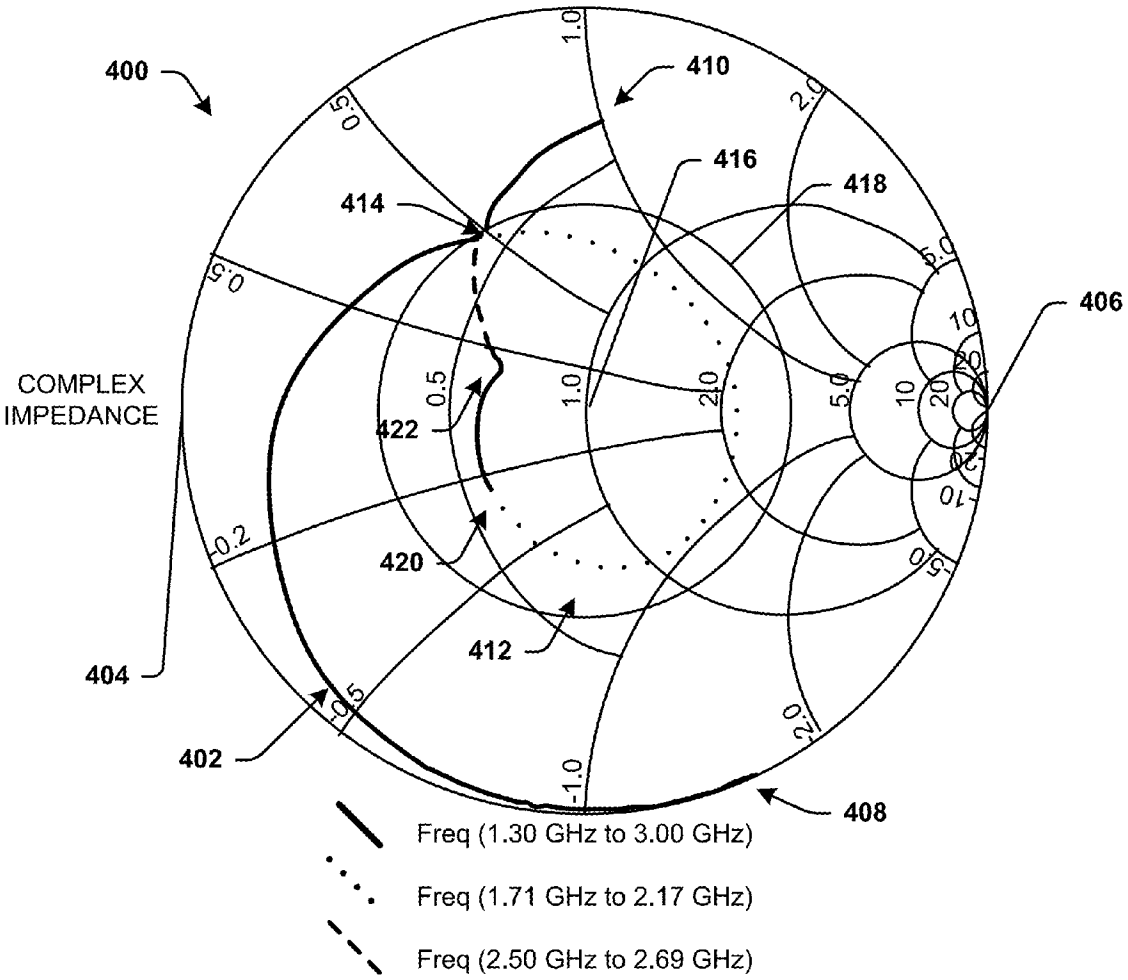
FIG. 4 is a diagram illustrating a Smith Chart of various components according to various aspects described.

FIG. 4, for example, illustrates a plot 402 of the impedance of the antenna element 202 at various frequencies. The Smith Chart 400 provides a left reference point 404 representing an antenna impedance of zero and a right reference point 406 representing an impedance of infinity. The plot 402 has a first point or a beginning point 408 and a second point or ending point 410. Points in the top half of the chart 400 represent impedances with a positive imaginary component and points in the bottom half of the chart 400 represent impedances with a negative imaginary component. The first point 408 provides an indication of the impedance of the antenna at a frequency of approximately 1.3 GHz. The second point 410 provides an indication of the impedance at a frequency of approximately 3 GHz. In general, as the frequency is increased, the impedance of the antenna moves clockwise from the point of high impedance to a point of lower impedance. The plot 402 includes a curl 412. The curl 412 provides an intersection point 414 at which the impedance plot 402 intersects with itself. The points along the curl 412 represent the frequencies at which the antenna element 202 is in resonance (e.g., the frequency bandwidth of the antenna).

The frequency at which the antenna element 202 is intended to resonate is determined by the intended use of the antenna element. A designer can shift the resonant frequencies of the antenna element according to the intended use. For example, if the antenna element 202 is not resonating at a sufficiently low frequency, the resonant frequency of the antenna element 202 can be shifted lower, which can shift the curl 412 counter clockwise along the plot illustrated in the Smith Chart. In addition to tuning the antenna element 202 to provide resonance at the desired frequency, the performance of the antenna element 202 can also be optimized by altering the bandwidth of the antenna. Once the curl is the desired size, the system 200 or 300, for example, can be further optimized so as to match the impedance of the coupler 110 to the impedance of the transceiver 212.

A standing wave ratio (SWR) of 1.0 can be represented by the prime center point 416. At this center point 416, the impedance of the feed 112 is perfectly matched with the impedance of the coupler 110, e.g., no reflected power is provided. In any given antenna, some mismatch in impedance can be present, however, the goal is to match the impedances of the antenna element or antenna to the feed as closely as possible, bringing the plot of antenna impedance as close to the prime center point 416 as possible. Typically, a SWR of 3.0 or lower is considered to provide an acceptable range of reflection. Thus, SWR 3.0 of circle 418 as illustrated in the Smith Chart represents antennas having a SWR of 3. The bandwidth of the antenna element 202, therefore, can be determined by observing the portions of the plot 402 that fall within the SWR of 3.0 of circle 418 and determining the frequencies associated with that portion of the plot 412 that increase the frequency range of the curl (e.g., increase the size of the curl). It has been determined that there typically is a limit to the benefit of increasing the size of the curl because it is still desirable to have the curl to fit within the SWR circle of 3, and thus a curl larger than the SWR circle of 3 may actually reduce the available bandwidth of the antenna system. Therefore, it can be beneficial to increase the size of the curl to a different size by changing the coupler element 110, and further moving the location of the curl toward the center with the appropriate matching network, which can be done without altering the physical dimensions of the antenna element 202.

Figure 5:
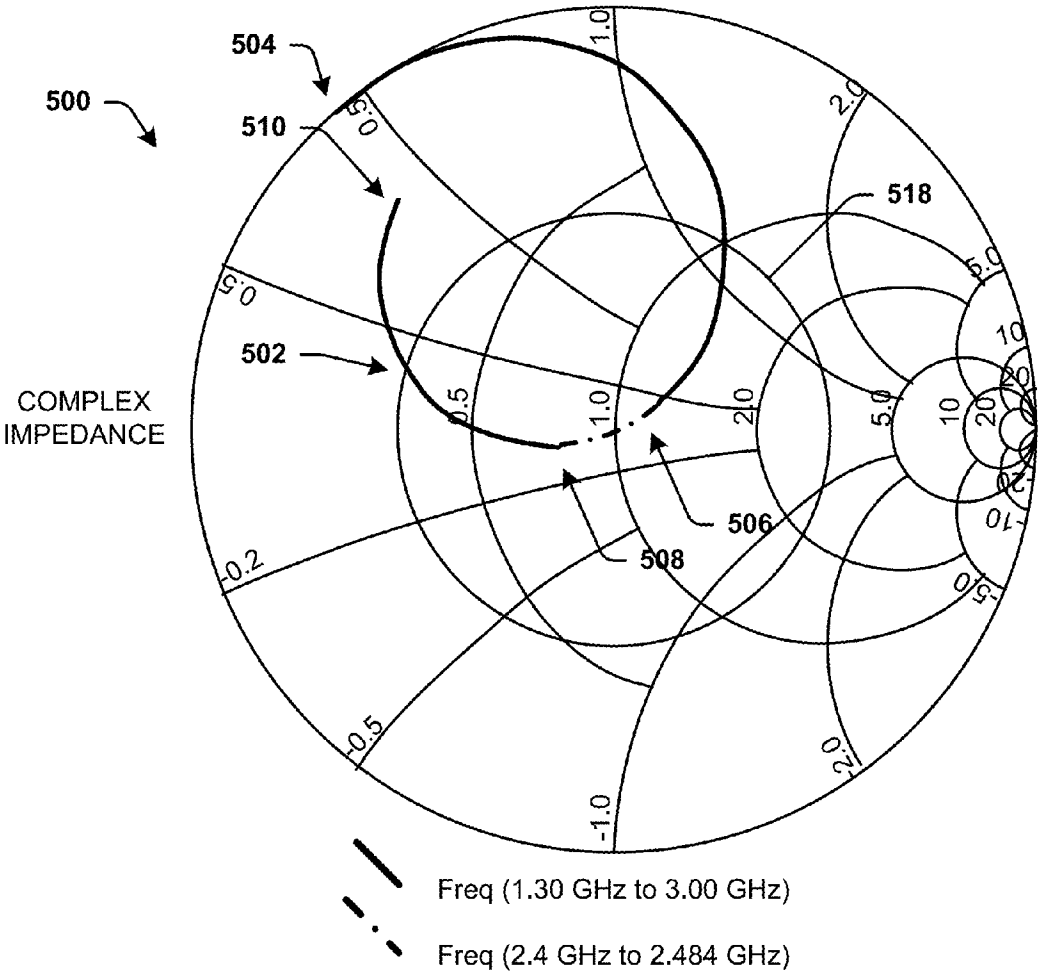
FIG. 5 is diagram illustrating another Smith Chart according to various aspects described.

The presently illustrated plot 402 therefore illustrates impedances of portions of the plot 402 along various frequencies for the feed element 112. The antenna element 202 can be configured to operate within a range of a cellular high band antenna (e.g., from about 1710 MHz to about 2690 MHz), in which frequencies beginning at 1.71 GHz can be shown by the dotted line beginning at the intersection 414 and ending at a point 420. After the point 420, frequencies between about 2.17 GHz and to 2.5 GHz can be seen along the dashed line beginning at point 422 and ending at the intersection point 414. As a comparison, FIG. 5 illustrates a plot 502 of an impedance of the antenna element 204, which, for example, can operate as a WLAN antenna element for the antenna system to simultaneously or concurrently communicate with a Wi-Fi network while the first antenna element 202 or the third antenna element 302 communicate via one or more other different networks. The antenna element 204, for example, can operate with a standard direct feed with a signal connection directly from a feed or transmitter rather than also via an electromagnetic coupling between a coupler element and the antenna element 204 with the feed or transmitter, or other like communication component. Other configurations of the second antenna element 204 can also be envisioned, in which the second antenna element can be a dual feed dual resonance antenna that comprises one or more of an indirect coupler or a direct coupling between the communication component and the antenna, or a single feed, dual resonance component, for example, which will be further discussed infra.

The plot 504, for example, begins at the point 504 and ends at the point 510 as frequencies are increased. Only a portion of the curve resides within the SWR circle 518, in which this portion represents the frequencies that would be desirable to not damage the transceiver, receiver, transmitter or other communication components. The curve thus reflects that the frequency range of about 2.4 GHz to about 2.484 GHz is near perfect matching or has very good impedance matching with the antenna element 202 at these frequencies.

Figure 6:
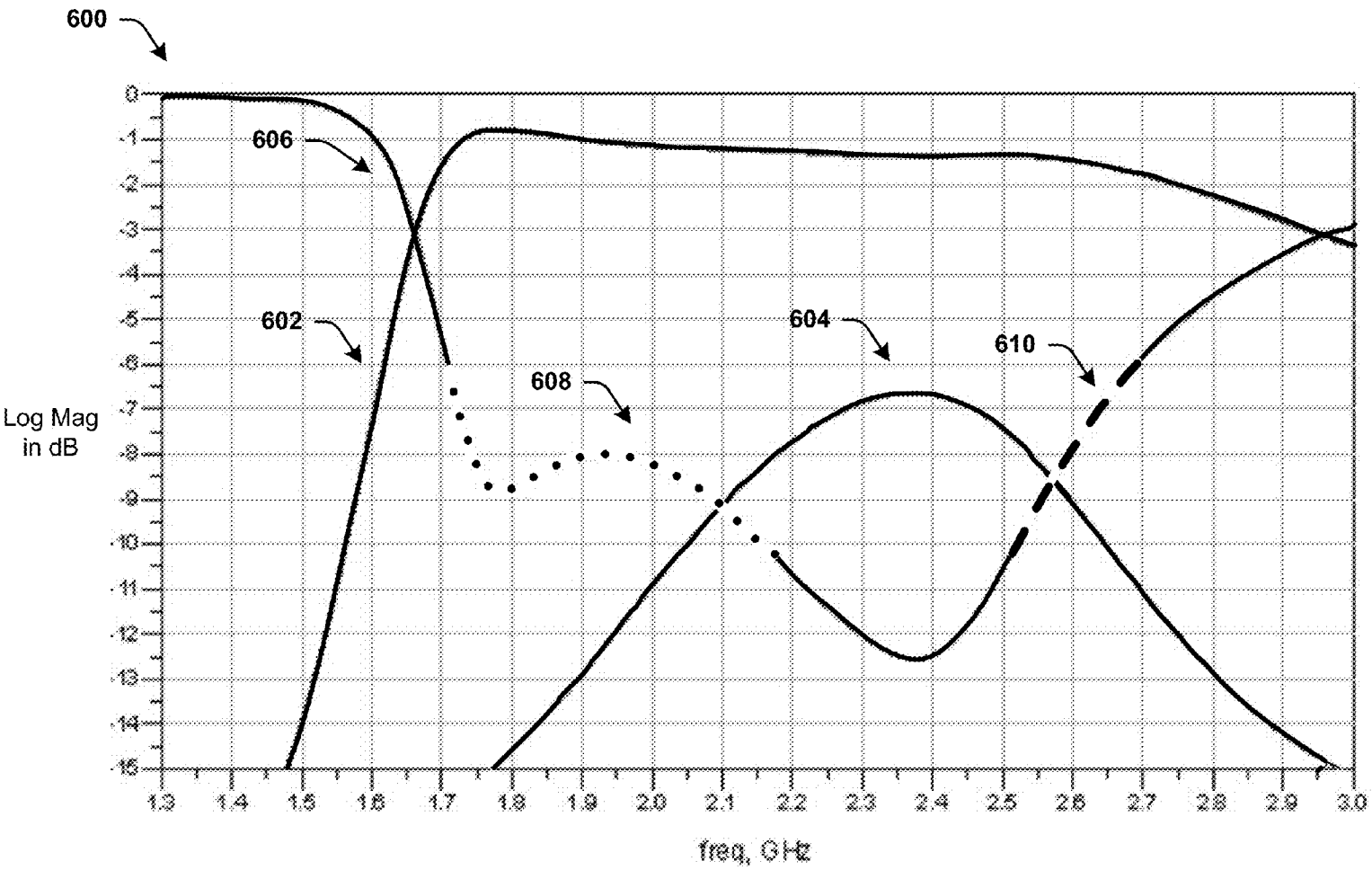
FIG. 6 is a diagram illustrating an isolation chart according to various aspects described.
Figure 7:
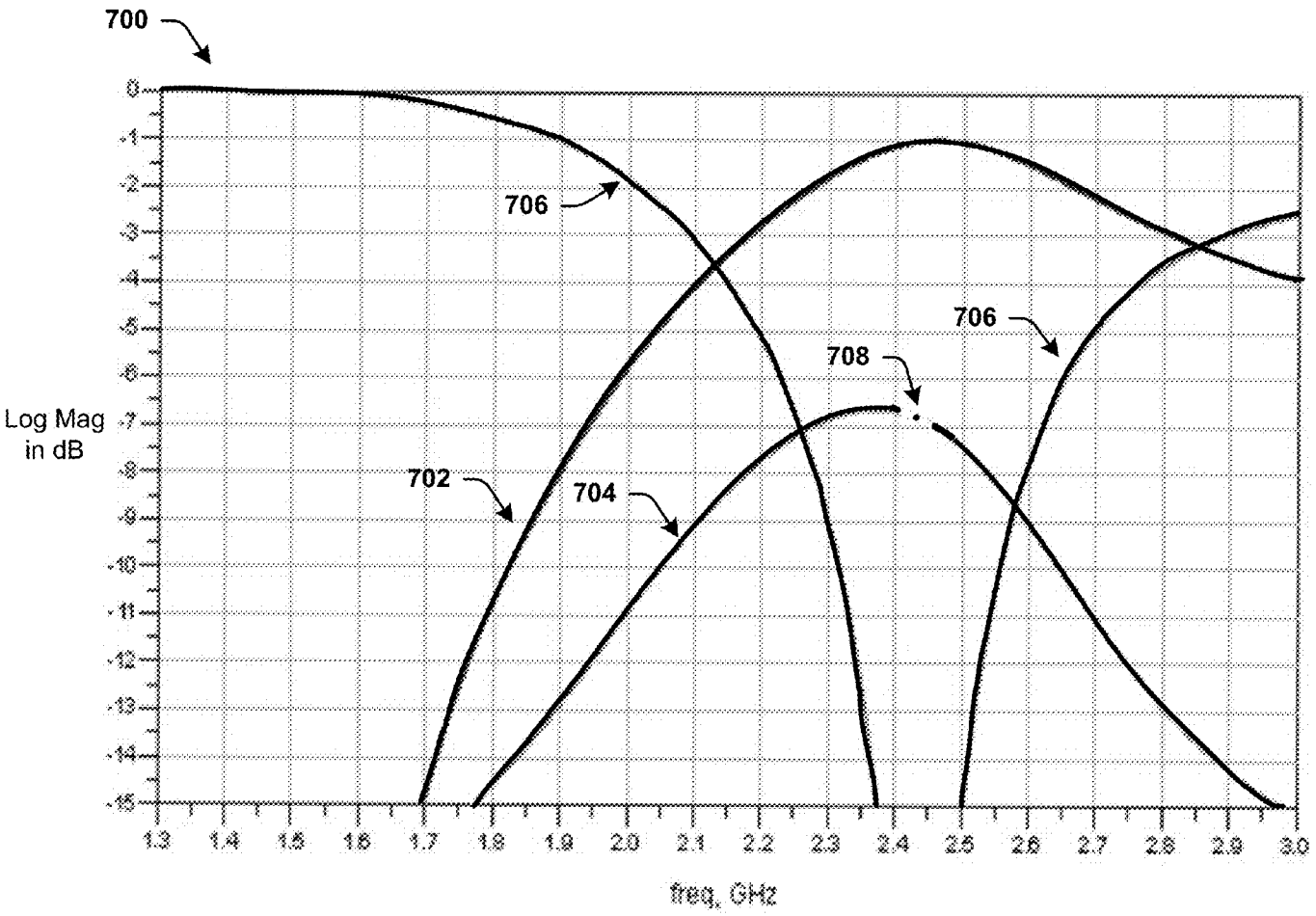
FIG. 7 is a diagram illustrating another isolation chart according to various aspects described.

Referring to FIGS. 6 and 7, illustrated are Log-Magnitude plots 600 and 700 of the impedance of the indirect feed 112 and direct feed of the second antenna port 108 respectively. The curves 602 and 702 illustrate the efficiencies of the antenna system, and the curves 604 and 704 represent the isolation curves in decibels versus frequencies in GHz of the antenna. The curves 606 and 706 further illustrate a reflection coefficient curve, which demonstrates the ratio of the amplitude of communication signals being reflected to the amplitude of an incident wave. In other words, the curves 606 and 706 illustrate a ratio of impedance toward a source and impedance toward a load. The dotted portion 608 of the curve 606 illustrates the antenna element 202 in a frequency range between about 1.71 GHz and about 2.17 GHz, and the portion 610 represents the frequency range between about 2.5 GHz to 2.69 GHz.

As illustrated by FIGS. 4-7, the antenna system comprises well matched impedances, but the isolation at WLAN 2.4 GHz as shown in the portion 708 of the isolation curve 704 by the broken line is only between 6 and 7 dB, which could be below a desired target of 10 to 15 dB. Poor isolation can thus result in efficiency loss, since part of the energy is coupled to the other antenna port and not radiated. In addition, poor isolation can result in a self-interference where a high power transmit signal from one antenna is disturbing a very low power receive signal on the other antenna. It is often the self-interference requirements that set the limit for or operate as a function of the isolation of an antenna system. Additionally, an advantage of the current antenna system is that having better isolation between the antennas could lessen the requirements to filters in the Rx chain in a receiver or transceiver and reduce the physical size, the price or the insertion loss of the antenna system overall.

Figure 8:
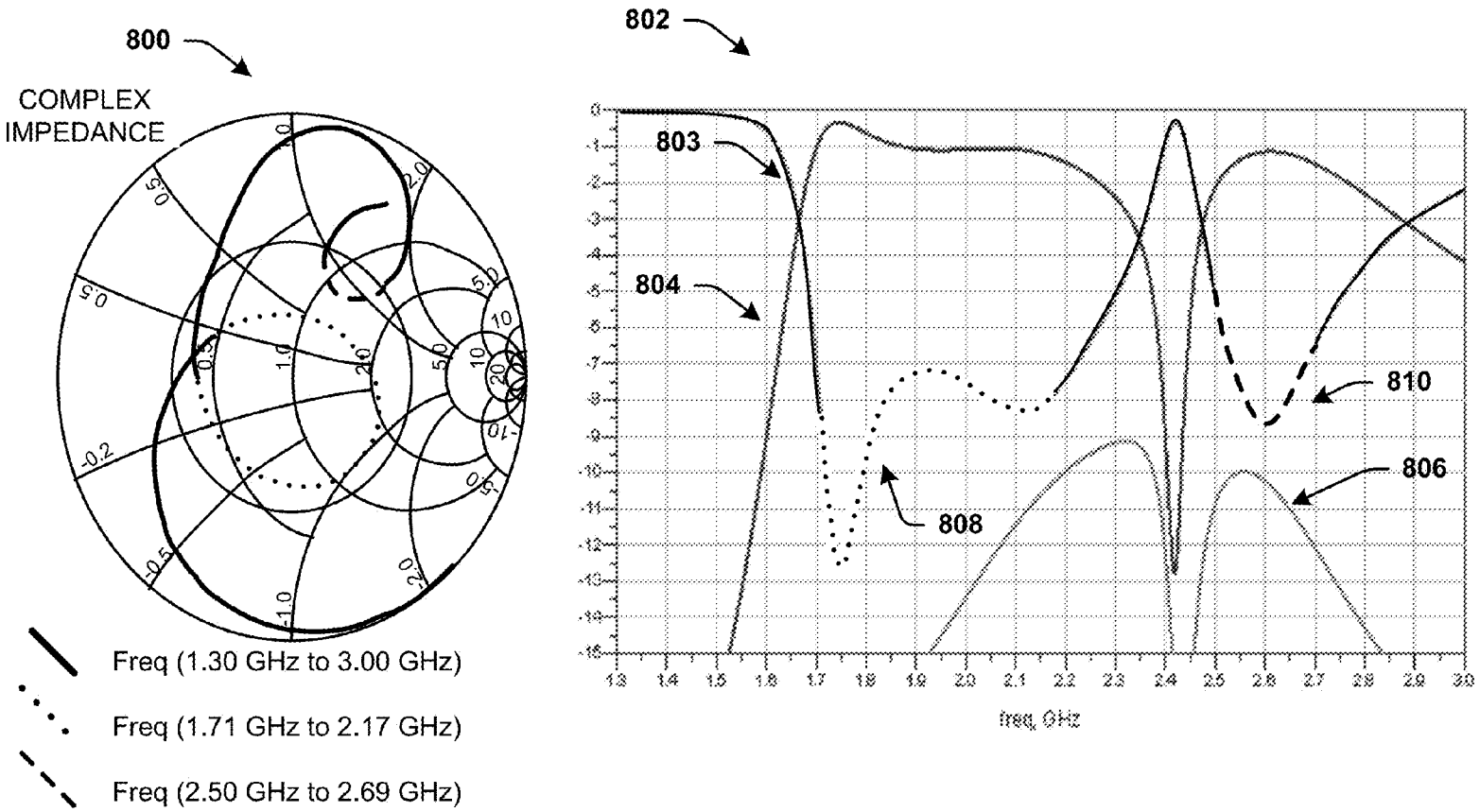
FIG. 8 is a diagram illustrating another Smith Chart and another isolation chart according to various aspects described.
Figure 9:
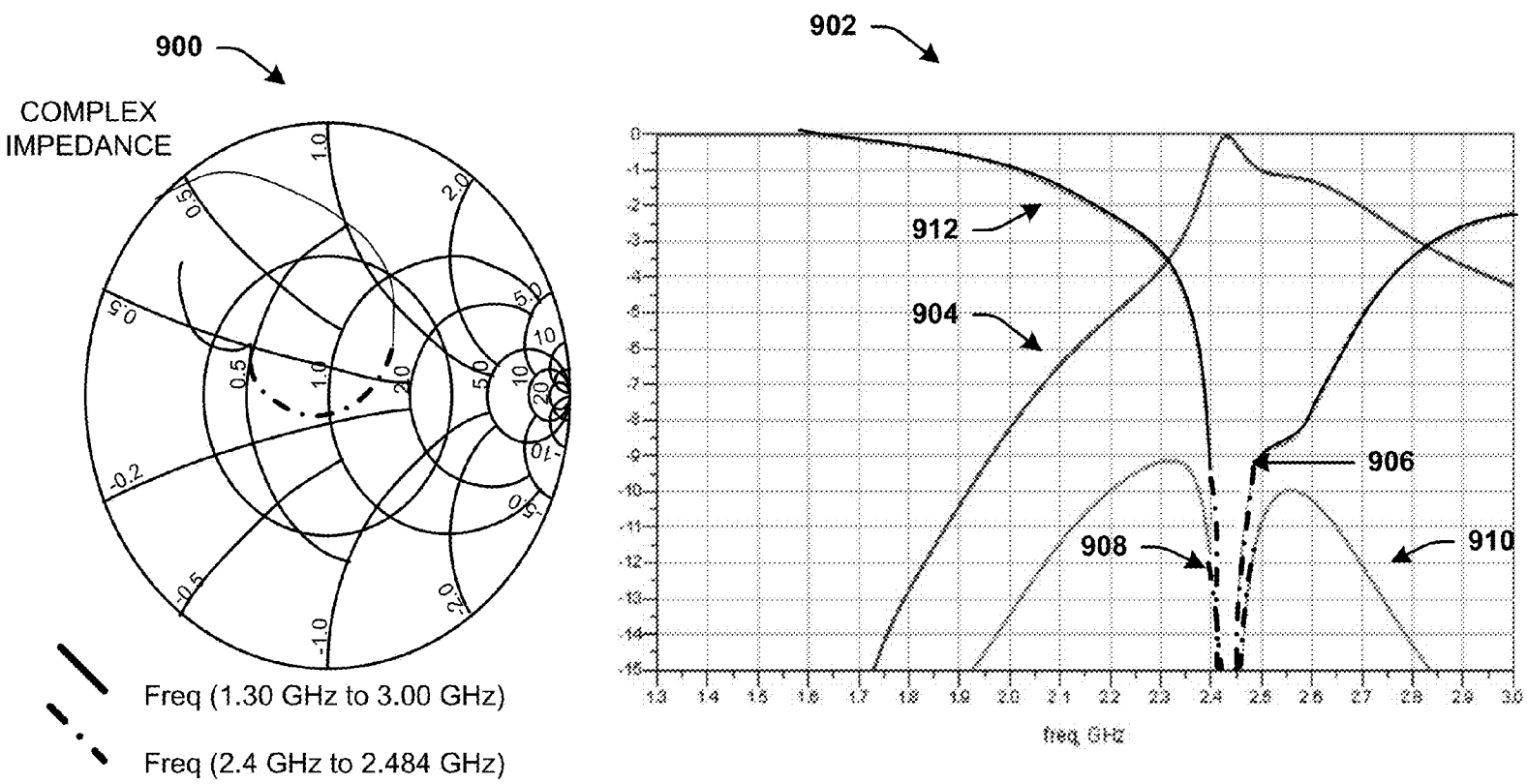
FIG. 9 is a diagram illustrating another Smith Chart and another isolation chart according to various aspects described.

Referring now to FIGS. 8 and 9, illustrated are examples of impedance plots 800, 900 and Log-Magnitude plots 802, 902 that reflect an addition of the antenna systems discussed above. The curve 804 demonstrates the efficiency of the antenna element and the curve 806 illustrates the isolation in decibels to frequency.

The first antenna element 202 comprises a cellular high band element, in which the first volume 104 comprises the same antenna element in previous examples discussed above, but the third antenna element 302 is added to operate within the higher frequency portion (2.5 GHz to about 2690 GHz) of the operating cellular high band frequency range (1.71 GHz to about 2.69 GHz). The tuning component 304 can be, for example, an inductor or other component coupled to the first antenna element 202 and the ground plant 116, which can operate as a re-tuning component to dynamically or statically facilitate the cellular high band antenna element to be specified for 1710 MHz to 2170 MHz and operate in a lower region of the frequency range of about 1710 MHz to about 2690 MHz. By tuning the frequency range of the first element 202 lower than approximately 2400 MHz and the resonance frequency of the third antenna element 302 higher than approximately 2484 MHz will facilitate improved isolation of the WLAN antenna. Further, the physical shape of the first antenna element 202 is maintained without having to significantly alter any dimension, while also obtaining good isolation in the adjacent second antenna element 204 designated for Wi-Fi networks.

The plot 800 illustrates a smaller curl in the center as a result of a retuning of the physical shape of the coupler 110 and the resonant frequency of the first antenna element 202. The retuning component can modify an inductance for example in order to control the range of the first antenna element 202. By decreasing the coupling of the coupler 110 to the first antenna element 202, the curl represented by the dotted line can become smaller than the curl illustrated in FIG. 4, which demonstrates that the frequency range controlled by the first antenna element 202 is more focused and the frequency range controlled by the third antenna element 302 can operate with a separate impedance, illustrated by the dashed line and separate curl for the frequency range of 2.5 GHz to 2.69 GHz. Therefore, the two elements operate with separate resonance impedances and the reflection coefficient curve 803 at portion 808 demonstrates matching in dBs, similar to previous Log-Magnitude plots, is efficient for communications. In addition, the matched frequency range equal to the Wi-Fi or the second antenna element 204 is able to be pushed out so that isolation occurs for the second antenna element 204 despite being adjacent the other first and third antenna elements, as is demonstrated within the frequency range of 2.4 GHz to about 2.5 GHz in the isolation chart 802.

As shown in FIG. 9, the plot 900 illustrates that the third antenna element 302 enables pushing the impedance at WLAN 2.4 GHz (2400 MHz to 2484 MHz) further out to the edge of the Smith Chart to obtain the improved isolation, while maintaining a good match at the cellular high band frequencies. The isolation curve 912 further demonstrates that the isolation is now at the edges 906 of the WLAN 2.4 GHz close to 12 dB at the point 908 of the isolation curve 910, while the center channels are isolated by more than 25 dB (not shown) as illustrated by the portions 906 of the S11 curve 912, which is a significant improvement, compared to the 6 to 7 dB isolations obtained previously. In addition, the efficiency is improved as demonstrated by the curve 904.

Figure 10:
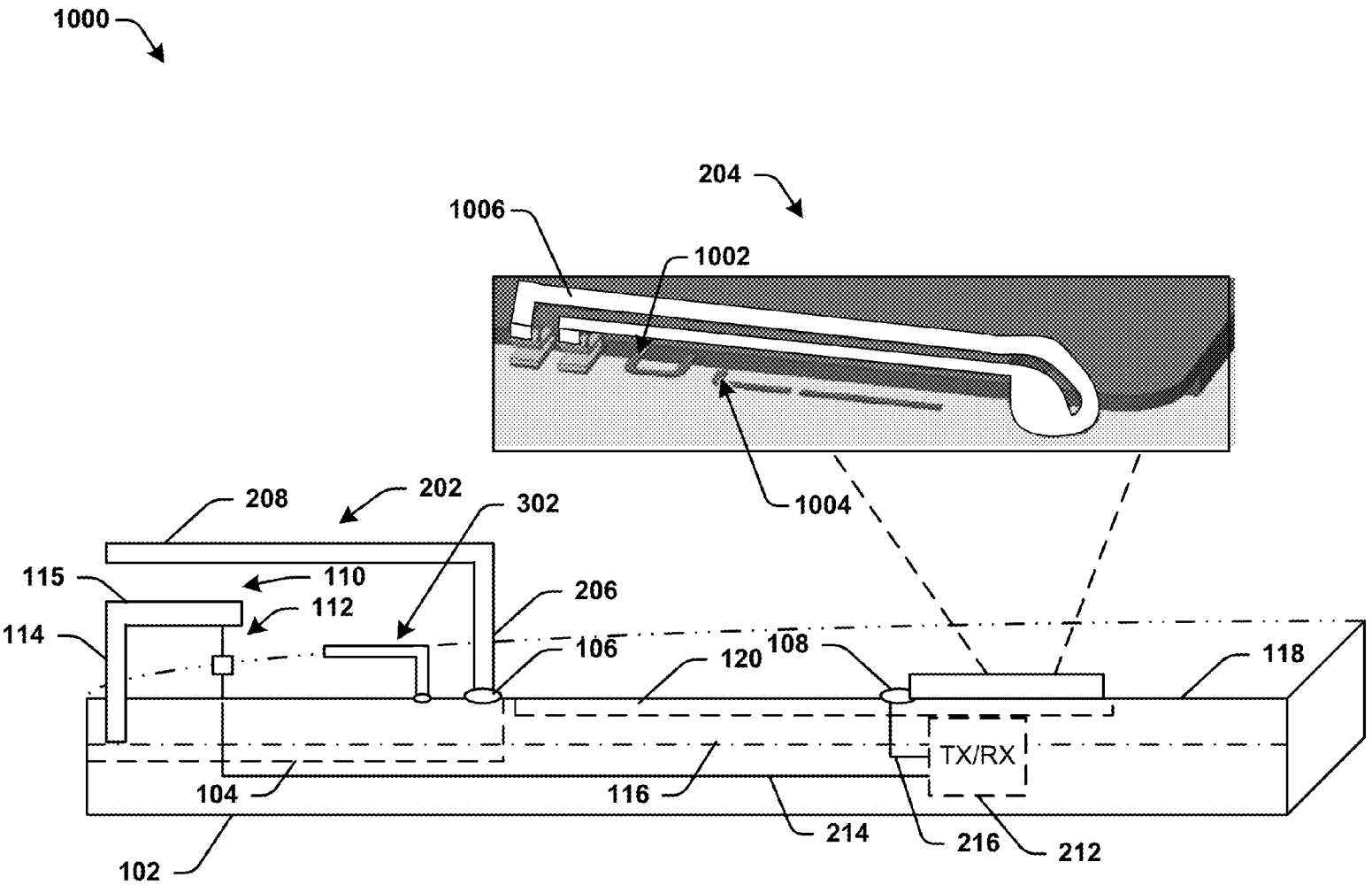
FIG. 10 is another block diagram of an antenna system according to various aspects described.

Referring to FIG. 10, illustrated is an example of an antenna system 1000 that comprises an additional example of the second antenna element 204 of the second volume 120. The first volume 104 includes the first antenna element 202 and the third antenna element 302, in which the first antenna element 202 is indirectly coupled via a capacitor, inductor or combination to a signal feed 112 via the coupler 110. The single coupled first antenna element 202 is adjacent and proximate to the second antenna element 204 that comprises a multiple coupled antenna element or a dual resonance antenna element 1006. The second antenna element 204, for example, can comprise more than one coupling element and comprise a single antenna element having multiple resonance frequencies (e.g., a low frequency band and Wi-Fi frequency bands). The first antenna element 202, for example, can be placed adjacent to the dual resonance antenna 1006, which covers cellular Rx low band from 734 MHz to 960 MHz, WLAN 2.4 GHz and 5.6 GHz, for example. The first antenna element 202 and elements within the volume 104 can operate within a cellular high band from about 1805 MHz to 2170 MHz and 2620 MHz to 2690 MHz. Frequency bands on both antenna volumes 104 and 120 can be operated concurrently or simultaneously for communications over cellular high band frequencies, cellular low band frequencies and different Wi-Fi frequencies.

The second antenna element 204, for example, can therefore be a multiple coupled element, in which the system 1000 can comprise two couplers 1002 and 1004 that cover one antenna element 1006 as a dual resonance single antenna element device. In this example, the second antenna element 204 comprises a dual resonance antenna element to cover two different frequency ranges (734 MHz to 960 MHz, WLAN 2.4 GHz or 5.6 GHz) with a single antenna element. The second antenna element 204 can be a single antenna element that operates as a dual resonance device, in which a low band communication is being covered in the frequencies from about 700 MHz to 960 MHz and Wi-Fi communication frequencies are covered with the same element as a dual resonance.

The second antenna element 204 is further coupled to dual couplers 1002 and 1004, but alternatively can be coupled via an electromagnetic coupling to the same coupler 110 instead of one or both couplers 1002 and 1004. The coupler 1002, for example, can comprise a WLAN coupler for covering WLAN frequencies, and the coupler 1004 can comprise a cellular low band coupler for covering cellular low band frequencies. The couplers 1002 or 1004 can operate to facilitate an indirect coupling to the dual resonance antenna element 1006. Alternatively, the second antenna element 204 can comprise one or more direct couplings to the communication component 212, such as via conductor or via the single indirect coupler 110. In addition or alternatively, the second antenna element 212 can comprise a single antenna element with a single resonance, such as for a WLAN antenna element or a cellular low band network antenna element.

While the methods described within this disclosure are illustrated in and described herein as a series of acts or events, it will be appreciated that the illustrated ordering of such acts or events are not to be interpreted in a limiting sense. For example, some acts may occur in different orders and/or concurrently with other acts or events apart from those illustrated and/or described herein. In addition, not all illustrated acts may be required to implement one or more aspects or embodiments of the description herein. Further, one or more of the acts depicted herein may be carried out in one or more separate acts and/or phases.

Figure 11:
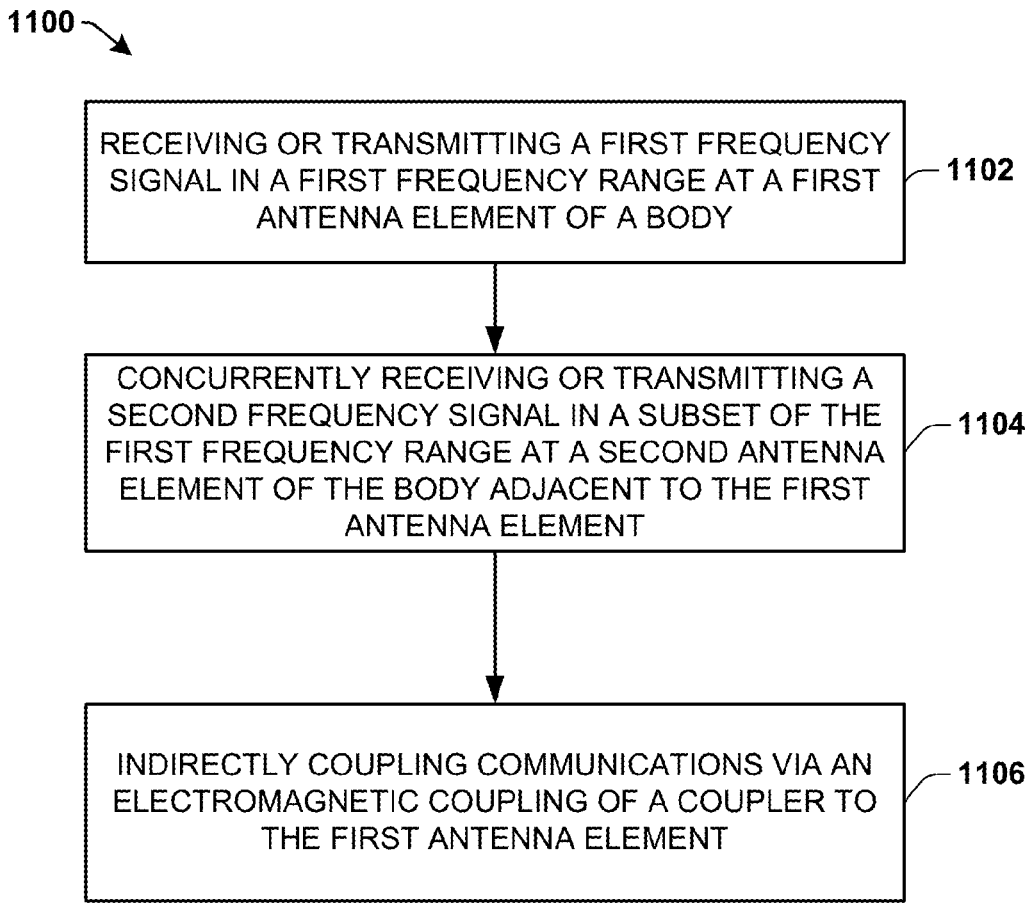
FIG. 11 is a flow diagram illustrating a method for an antenna device according to various aspects described.

Referring now to FIG. 11, illustrated is a method 1100 for operating an antenna system as disclosed herein. The method 1100 initiates at 1102 by receiving or transmitting a first frequency signal in a first frequency range (e.g., about 1700 MHz to 2700 MHz) at a first antenna element (e.g., antenna element 202) of a body. The receiving or the transmitting of the first radio frequency signal can comprise indirectly coupling communications via a capacitive or inductive coupling to the first antenna element.

At 1104, the method comprises concurrently or simultaneously receiving or transmitting, at a second antenna element (e.g., antenna element 204) of the body that is adjacent to the first antenna element of the body, a second frequency signal in a second frequency range (e.g., about 2400 MHz to 2485 MHz) that comprises a subset of the first frequency range.

At 1106, a coupler operates to indirectly couple communications via an electromagnetic coupling to the first antenna element. The coupler (e.g., coupler 110) can indirectly couple multiple antenna elements operating at different operating frequencies of different frequency ranges corresponding to each element. An indirect coupling is different from a direct coupling, as discussed above. The direct coupling includes a direct connect (e.g., connection 216) from a communication component 212 to an antenna element (e.g., the second antenna element 204). In contrast, the indirect coupling provides a coupler that electromagnetically couples the antenna element (e.g., the first antenna element 202, the third antenna element 302, or both the first and the third antenna elements) to the feed (e.g., feed component 112) and the communication component (e.g., communication component 212).

The method can additionally or alternatively comprise concurrently or simultaneously receiving or transmitting, at a third antenna element located within a same volume of the body as the first antenna element (e.g., third antenna element 302), a third frequency signal in a third frequency range that comprises a subset of the first frequency range. The subset frequency range of the third antenna element can be a different subset of the first frequency range than the subset of the second antenna element, such as, for example, about 2500 MHz to 2700 MHz). In one embodiment, the coupler (e.g., coupler 110) is configured to indirectly (electromagnetically, inductively or capacitively) couple the first antenna element 202 and the third antenna element 302 in the same volume 104, which are resonating at different frequencies concurrently, at about the same time or simultaneously.

The method 1100 can further comprise tuning the first antenna element of the body to receive or transmit the first frequency signal at a second different subset of the first frequency range that is a lower frequency range than the subset and the different subset of the first frequency range, which is covered by the second or third antenna elements, for example. Alternatively or additionally, the method 1100 can comprise concurrently receiving or transmitting, at the second antenna element, a fourth frequency signal in a fourth frequency range that is lower than the first frequency range.

Figure 12:
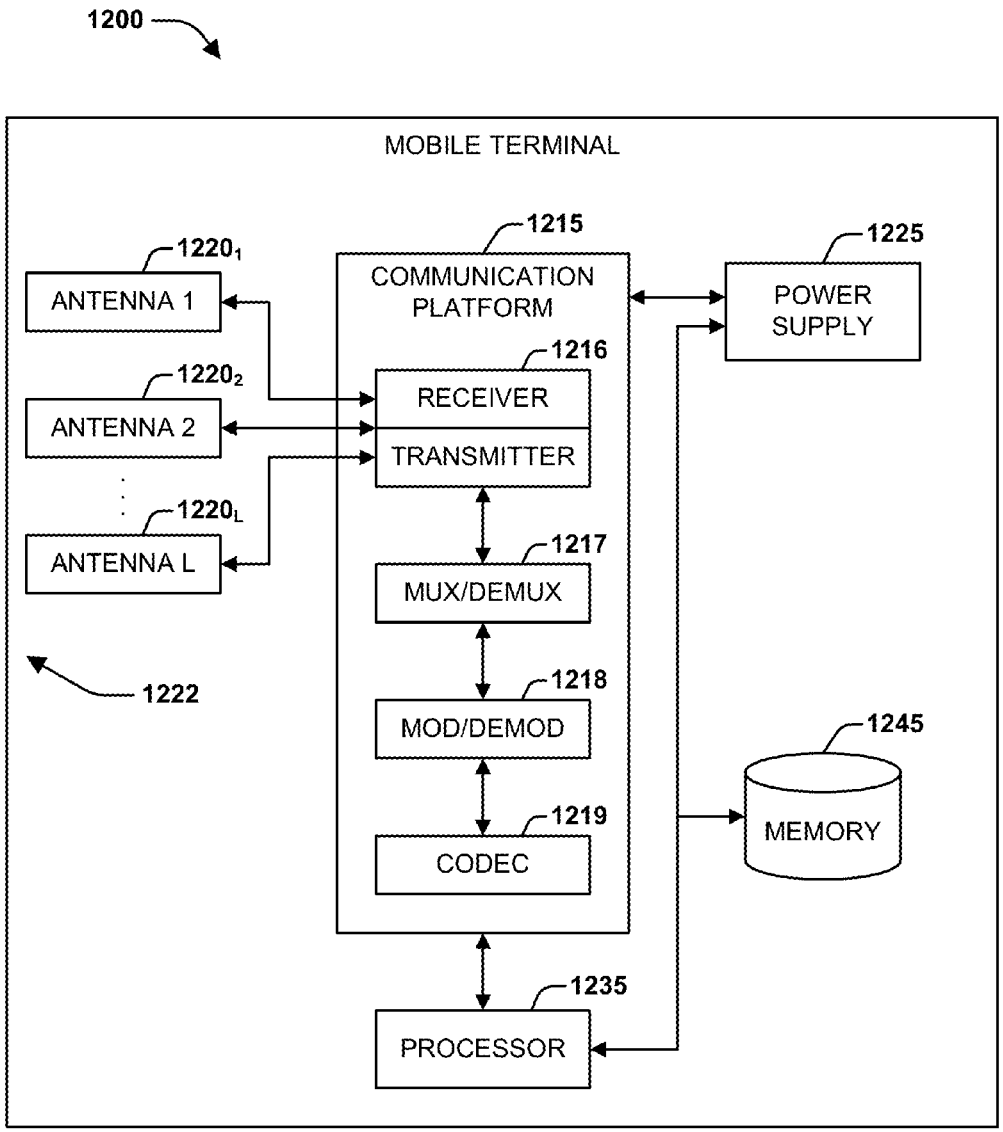
FIG. 12 is a block diagram illustrating a mobile communication device that may incorporate the antenna system according to various aspects described.

In order to provide further context for various aspects of the disclosed subject matter, FIG. 12 illustrates a non-limiting example mobile device or terminal 1200 that can implement some or all of the aspects described herein. In an aspect, wireless terminal 1200 can receive and transmit signal(s) to and/or from wireless devices such as APs, access terminals, wireless ports and routers, or the like, through a set of L antennas 1220. In one example, antennas 1220 can be implemented as part of a communication platform 1215, which in turn can comprise electronic components and associated circuitry and/or other means that provide for processing and manipulation of received signal(s) and signal(s) to be transmitted. The antennas 1220 can comprise the first antenna element, the second antenna element and the third antenna element incorporating the different aspects or embodiments disclosed herein. In one example, the antennas 1220 can be located along an edge or side 1220 of the mobile terminal 1200, which can be within a same quadrant, section, portion or subset of the volume of the mobile device.

In an aspect, communication platform 1215 can include a receiver/transmitter or transceiver 1216, which can transmit and receive signals and/or perform one or more processing operations on such signals (e.g., conversion from analog to digital upon reception, conversion from digital to analog upon transmission, etc.). In addition, transceiver 1216 can divide a single data stream into multiple, parallel data streams, or perform the reciprocal operation.

In another example, a multiplexer/demultiplexer (mux/demux) unit 1217 can be coupled to transceiver 1216. Mux/demux unit 1217 can, for example, facilitate manipulation of signal in time and frequency space. Additionally or alternatively, mux/demux unit 1217 can multiplex information (e.g., data/traffic, control/signaling, etc.) according to various multiplexing schemes such as time division multiplexing (TDM), frequency division multiplexing (FDM), orthogonal frequency division multiplexing (OFDM), code division multiplexing (CDM), space division multiplexing (SDM), or the like. In addition, mux/demux unit 1217 can scramble and spread information according to substantially any code generally known in the art, such as Hadamard-Walsh codes, Baker codes, Kasami codes, polyphase codes, and so on.

In a further example, a modulator/demodulator (mod/demod) unit 1218 implemented within communication platform 1215 can modulate information according to multiple modulation techniques, such as frequency modulation, amplitude modulation (e.g., L-ary quadrature amplitude modulation (L-QAM), etc.), phase-shift keying (PSK), and the like. Further, communication platform 1215 can also include a coder/decoder (codec) module 1219 that facilitates decoding received signal(s) and/or coding signal(s) to convey.

According to another aspect, wireless terminal 1200 can include a processor 1235 configured to confer functionality, at least in part, to substantially any electronic component utilized by wireless terminal 1200. As further shown in system 1200, a power supply 1225 can attach to a power grid and include one or more transformers to achieve a power level at which various components and/or circuitry associated with wireless terminal 1200 can operate. In one example, power supply 1225 can include a rechargeable power mechanism to facilitate continued operation of wireless terminal 1200 in the event that wireless terminal 1200 is disconnected from the power grid, the power grid is not operating, etc.

In a further aspect, processor 1235 can be functionally connected to communication platform 1215 and can facilitate various operations on data (e.g., symbols, bits, chips, etc.), which can include, but are not limited to, effecting direct and inverse fast Fourier transforms, selection of modulation rates, selection of data packet formats, inter-packet times, etc. In another example, processor 1235 can be functionally connected, via a data or system bus, to any other components or circuitry not shown in system 1200 to at least partially confer functionality to each of such components.

As additionally illustrated in the mobile terminal 1200, a memory 1245 can be used by wireless terminal 1200 to store data structures, code instructions and program modules, system or device information, code sequences for scrambling, spreading and pilot transmission, location intelligence storage, determined delay offset(s), over-the-air propagation models, and so on. Processor 1235 can be coupled to the memory 1245 in order to store and retrieve information necessary to operate and/or confer functionality to communication platform 1215 and/or any other components of wireless terminal 1200.

Examples may include subject matter such as a method, means for performing acts or blocks of the method, at least one machine-readable medium including instructions that, when performed by a machine cause the machine to perform acts of the method or of an apparatus or system for concurrent communication using multiple communication technologies according to embodiments and examples described herein.

Example 1 is an antenna system that comprises a first antenna element, located within a first antenna volume of a body, configured to operate at a first resonant frequency range. A second antenna element is located within a second antenna volume of the body that is adjacent to the first antenna element and the first antenna volume and is configured to operate at a second resonant frequency range that is a subset of the first resonant frequency range. The system further comprises an indirect coupler configured to indirectly couple the first antenna element with a feed signal component for transmitting and receiving communications.

Example 2 includes the subject matter of Example 1 and a third antenna element, located within the first antenna volume, is configured to operate at a third resonant frequency range that is a different subset of the first frequency range than the subset of the first resonant frequency range. The indirect coupler is further configured to indirectly couple the third antenna element with the feed signal component.

Example 3 includes the subject matter of any of Examples 1 and 2 including or omitting optional elements, and wherein the first antenna element, the second antenna element and the third antenna element are configured to concurrently transmit and receive different communications within the first resonant frequency range.

Example 4 includes the subject matter of any of Examples 1-3, including or omitting optional elements, wherein the first antenna element comprises a cellular high band antenna element and the second antenna element comprises a wireless local area network antenna element.

Example 5 includes the subject matter of any of Examples 1-4, including or omitting optional elements, wherein the first antenna element is configured to operate at the first resonant frequency range that comprises about 1710 MHz to about 2690 MHz, and the second antenna element is configured to operate at the second resonant frequency range comprising about 2400 MHz to about 2484 MHz.

Example 6 includes the subject matter of any of Examples 1-5, including or omitting optional elements, wherein the first antenna element is further configured to span a dimension of the first antenna volume of the body, and the indirect coupler is located within the first antenna volume.

Example 7 includes the subject matter of any of Examples 1-6, including or omitting optional elements, wherein the first antenna element is coupled to a tuning component configured to facilitate the first antenna element to resonate at a lower subset of the first resonant frequency range than the subset of the first frequency range that corresponds to the second antenna element.

Example 8 includes the subject matter of any of Examples 1-7, including or omitting optional elements, wherein the first antenna volume and the second antenna volume are located adjacent to one another on a same side of the body in a portion of the body.

Example 9 includes the subject matter of any of Examples 1-8, including or omitting optional elements, wherein the second antenna element is further configured to operate at a fourth resonant frequency range that is lower than the first resonant frequency range.

Example 10 includes the subject matter of any of Examples 1-9, including or omitting optional elements, wherein the second antenna element comprises a dual resonance antenna element and the second antenna volume comprises a wireless local access network coupler for a wireless local access network antenna resonance and a cellular low band coupler for a cellular low band antenna resonance.

Example 11 is a mobile device or apparatus comprising a first antenna port that is located at a first antenna volume and is configured to communicate at a first frequency range in response to a first antenna element coupled thereto. A second antenna port, located at a second antenna volume that is adjacent to the first antenna volume, is configured to communicate at a second frequency range that is a subset of the first frequency range in response to a second antenna element coupled thereto. The device further comprises a coupler that is located within the first antenna volume and is configured to indirectly communicatively couple communication signals to the first antenna port. The second antenna port and the first antenna port are further configured to concurrently transmit or receive different communications within the first frequency range.

Example 12 includes the subject matter of any of Examples 11, wherein a third antenna port is located within the first antenna volume and is configured to communicate, in response to a third antenna element coupled thereto, at a third frequency range that is a different subset of the first frequency range than the subset of the first resonant frequency range. In another example, the first antenna element, the second antenna element and the third antenna element are configured to concurrently transmit and receive different communications within the first frequency range.

Example 13 includes the subject matter of Examples 11 and 12, including or omitting optional elements, wherein the different subset of the first frequency range comprises an upper frequency range, and the subset of the first frequency range comprises an adjacent frequency range to the upper frequency range.

Example 14 includes the subject matter of any of Examples 11-13, including or omitting optional elements, wherein the coupler electromagnetically couples the communication signals to the first antenna port and to the third antenna port.

Example 15 includes the subject matter of any of Examples 11-14, including or omitting optional elements, wherein a tuning component configured to tune the first antenna port to communicate at a lower frequency range of the first frequency range than the subset and the different subset of the first frequency range.

Example 16 includes the subject matter of any of Examples 11-15, including or omitting optional elements, wherein the first antenna port communicatively couples a cellular high band antenna element as the first antenna element to the coupler and the second antenna port is communicatively coupled to a wireless local area network antenna element or to a cellular low band network antenna element, as the second antenna element.

Example 17 includes the subject matter of any of Examples 11-16, including or omitting optional elements, a transceiver configured to receive or transmit the different communications that is coupled to the coupler via a feed component and to the second antenna.

Example 18 includes the subject matter of any of Examples 11-17, including or omitting optional elements, wherein the coupler electromagnetically couples the communication signals to the first antenna port and to the second antenna port via an electromagnetic coupling to a feed component and a communication component, the first antenna port further configured to communicate at different subset frequency range than the subset of the first frequency range of the second antenna port.

Example 19 is a method comprising receiving or transmitting a first frequency signal in a first frequency range at a first antenna element of a body. A second frequency signal is concurrently received or transmitted at a second antenna element of the body that is adjacent to the first antenna element of the body and in a second frequency range that comprises a subset of the first frequency range. The method further comprises indirectly coupling communications via an electromagnetic coupling of a coupler to the first antenna element.

Example 20 includes the subject matter of Examples 19, including or omitting optional elements, wherein the method further comprises concurrently receiving or transmitting, at a third antenna element located within a same volume of the body as the first antenna element, a third frequency signal in a third frequency range that comprises a different subset of the first frequency range than the subset of the first frequency range.

Example 21 includes the subject matter of Examples 19 and 20 including or omitting optional elements, wherein the method further comprises indirectly coupling the communications via the electromagnetic coupling of the coupler to the first antenna element and the third antenna element.

Example 22 includes the subject matter of any of Examples 19-21, including or omitting optional elements, wherein the method further comprises tuning the first antenna element of the body to receive or transmit the first frequency signal at a second different subset of the first frequency range that is a lower frequency range than the subset and the different subset of the first frequency range.

Example 23 includes the subject matter of any of Examples 19-22, including or omitting optional elements, wherein the method further comprises concurrently receiving or transmitting, at the second antenna element, a fourth frequency signal in a fourth frequency range that is lower than the first frequency range.

Example 24 includes the subject matter of any of Examples 19-23, including or omitting optional elements, wherein the receiving or the transmitting the first frequency signal in the first frequency range at the first antenna element of the body comprises receiving or transmitting the first frequency signal at a cellular high band antenna element, and the receiving or the transmitting at the second antenna element comprises receiving and transmitting the second frequency signal at a wireless local area network antenna element or cellular low band antenna element.

Example 25 includes the subject matter of any of Examples 19-24, including or omitting optional elements, wherein the coupler electromagnetically couples the communication signals to the first antenna port and to the second antenna port via an electromagnetic coupling to a feed component and a communication component, the first antenna port further configured to communicate at different subset frequency range than the subset of the first frequency range of the second antenna port.

Example 26 includes an antenna system for a mobile device comprising a first antenna element means, located in an antenna volume of a body, configured to receive or transmit a first frequency signal in a first frequency range. A second antenna element means, located adjacent the first antenna means, is configured to receive or transmit a second frequency signal in a second frequency range that comprises a subset of the first frequency range. A coupling means is configured to indirectly couple communications via an electromagnetic coupling to the first antenna element.

Example 27 includes the subject matter of Example 26 and a third antenna element means, located within the antenna volume and adjacent to the first antenna means, configured to receive or transmit a third frequency signal in a third frequency range that comprises a different subset of the first frequency range than the subset of the first frequency range.

Example 28 includes the subject matter of any of Examples 26 and 27, including or omitting optional elements, wherein the coupling means is further configured to indirectly couple the communications via the electromagnetic coupling to the first antenna element and the third antenna element.

Applications (e.g., program modules) can include routines, programs, components, data structures, etc., that perform particular tasks or implement particular abstract data types. Moreover, those skilled in the art will appreciate that the operations disclosed can be practiced with other system configurations, including single-processor or multiprocessor systems, minicomputers, mainframe computers, as well as personal computers, hand-held computing devices, microprocessor-based or programmable consumer electronics, and the like, each of which can be operatively coupled to one or more associated mobile or personal computing devices.

A computing device can typically include a variety of computer-readable media. Computer readable media can be any available media that can be accessed by the computer and includes both volatile and non-volatile media, removable and non-removable media. By way of example and not limitation, computer-readable media can comprise computer storage media and communication media. Computer storage media includes both volatile and non-volatile, removable and non-removable media implemented in any method or technology for storage of information such as computer-readable instructions, data structures, program modules or other data. Computer storage media (e.g., one or more data stores) can include, but is not limited to, RAM, ROM, EEPROM, flash memory or other memory technology, CD ROM, digital versatile disk (DVD) or other optical disk storage, magnetic cassettes, magnetic tape, magnetic disk storage or other magnetic storage devices, or any other medium which can be used to store the desired information and which can be accessed by the computer.

Communication media typically embodies computer-readable instructions, data structures, program modules or other data in a modulated data signal such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

It is to be understood that aspects described herein may be implemented by hardware, software, firmware, or any combination thereof. When implemented in software, functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if software is transmitted from a website, server, or other remote source using a coaxial cable, fiber optic cable, twisted pair, digital subscriber line (DSL), or wireless technologies such as infrared, radio, and microwave, then coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

Various illustrative logics, logical blocks, modules, and circuits described in connection with aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform functions described herein. A general-purpose processor may be a microprocessor, but, in the alternative, processor may be any conventional processor, controller, microcontroller, or state machine. A processor may also be implemented as a combination of computing devices, for example, a combination of a DSP and a microprocessor, a plurality of microprocessors, one or more microprocessors in conjunction with a DSP core, or any other such configuration. Additionally, at least one processor may comprise one or more modules operable to perform one or more of the acts and/or actions described herein.

For a software implementation, techniques described herein may be implemented with modules (e.g., procedures, functions, and so on) that perform functions described herein. Software codes may be stored in memory units and executed by processors. Memory unit may be implemented within processor or external to processor, in which case memory unit can be communicatively coupled to processor through various means as is known in the art. Further, at least one processor may include one or more modules operable to perform functions described herein.

Techniques described herein may be used for various wireless communication systems such as CDMA, TDMA, FDMA, OFDMA, SC-FDMA and other systems. The terms "system" and "network" are often used interchangeably. A CDMA system may implement a radio technology such as Universal Terrestrial Radio Access (UTRA), CDMA2000, etc. UTRA includes Wideband-CDMA (W-CDMA) and other variants of CDMA. Further, CDMA2000 covers IS-2000, IS-95 and IS-856 standards. A TDMA system may implement a radio technology such as Global System for Mobile Communications (GSM). An OFDMA system may implement a radio technology such as Evolved UTRA (E-UTRA), Ultra Mobile Broadband (UMB), IEEE 802.11 (Wi-Fi), IEEE 802.16 (WiMAX), IEEE 802.20, Flash-OFDM, etc. UTRA and E-UTRA are part of Universal Mobile Telecommunication System (UMTS). 3GPP Long Term Evolution (LTE) is a release of UMTS that uses E-UTRA, which employs OFDMA on downlink and SC-FDMA on uplink. UTRA, E-UTRA, UMTS, LTE and GSM are described in documents from an organization named "3rd Generation Partnership Project" (3GPP). Additionally, CDMA2000 and UMB are described in documents from an organization named "3rd Generation Partnership Project 2" (3GPP2). Further, such wireless communication systems may additionally include peer-to-peer (e.g., mobile-to-mobile) ad hoc network systems often using unpaired unlicensed spectrums, 802.xx wireless LAN, BLUETOOTH and any other short- or long-range, wireless communication techniques.

Single carrier frequency division multiple access (SC-FDMA), which utilizes single carrier modulation and frequency domain equalization is a technique that can be utilized with the disclosed aspects. SC-FDMA has similar performance and essentially a similar overall complexity as those of OFDMA system. SC-FDMA signal has lower peak-to-average power ratio (PAPR) because of its inherent single carrier structure. SC-FDMA can be utilized in uplink communications where lower PAPR can benefit a mobile terminal in terms of transmit power efficiency.

Moreover, various aspects or features described herein may be implemented as a method, apparatus, or article of manufacture using standard programming and/or engineering techniques. The term "article of manufacture" as used herein is intended to encompass a computer program accessible from any computer-readable device, carrier, or media. For example, computer-readable media can include but are not limited to magnetic storage devices (e.g., hard disk, floppy disk, magnetic strips, etc.), optical discs (e.g., compact disc (CD), digital versatile disc (DVD), etc.), smart cards, and flash memory devices (e.g., EPROM, card, stick, key drive, etc.). Additionally, various storage media described herein can represent one or more devices and/or other machine-readable media for storing information. The term "machine-readable medium" can include, without being limited to, wireless channels and various other media capable of storing, containing, and/or carrying instruction(s) and/or data. Additionally, a computer program product may include a computer readable medium having one or more instructions or codes operable to cause a computer to perform functions described herein.

Further, the acts and/or actions of a method or algorithm described in connection with aspects disclosed herein may be embodied directly in hardware, in a software module executed by a processor, or a combination thereof. A software module may reside in RAM memory, flash memory, ROM memory, EPROM memory, EEPROM memory, registers, a hard disk, a removable disk, a CD-ROM, or any other form of storage medium known in the art. An exemplary storage medium may be coupled to processor, such that processor can read information from, and write information to, storage medium. In the alternative, storage medium may be integral to processor. Further, in some aspects, processor and storage medium may reside in an ASIC. Additionally, ASIC may reside in a user terminal. In the alternative, processor and storage medium may reside as discrete components in a user terminal. Additionally, in some aspects, the acts and/or actions of a method or algorithm may reside as one or any combination or set of codes and/or instructions on a machine-readable medium and/or computer readable medium, which may be incorporated into a computer program product.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

In particular regard to the various functions performed by the above described components or structures (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention. In addition, while a particular feature may have been disclosed with respect to only one of several implementations, such feature may be combined with one or more other features of the other implementations as may be desired and advantageous for any given or particular application.

What is claimed is:

1. An antenna system comprising:

a first antenna element, located within a first antenna volume of a body, configured to operate at a first resonant frequency range;

a second antenna element, located within a second antenna volume of the body that is adjacent to the first antenna element and the first antenna volume, configured to operate at a second resonant frequency range that is a subset of the first resonant frequency range;

a third antenna element, located within the first antenna volume, configured to operate at a third resonant frequency range that is a different subset of the first frequency range than the second resonant frequency range that is the subset of the first resonant frequency range; and an indirect coupler configured to indirectly couple communications associated with the first antenna element and the third antenna element with a feed signal component for transmitting and receiving the communications.

2. The antenna system of claim 1, wherein the first antenna element, the second antenna element and the third antenna element are configured to concurrently transmit and receive different communications within the first resonant frequency range.

3. The antenna system of claim 1, wherein the first antenna element comprises a cellular high band antenna element and the second antenna element comprises a wireless local area network antenna element.

4. The antenna system of claim 1, wherein the first antenna element is configured to operate at the first resonant frequency range that comprises about 1710 MHz to about 2690 MHz, and the second antenna element is configured to operate at the second resonant frequency range comprising about 2400 MHz to about 2484 MHz.

5. The antenna system of claim 1, wherein the first antenna element is further configured to span a dimension of the first antenna volume of the body, and the indirect coupler is located within the first antenna volume.

6. The antenna system of claim 1, wherein the first antenna element is coupled to a tuning component configured to facilitate the first antenna element to resonate at a lower subset of the first resonant frequency range than the subset of the first frequency range that corresponds to the second antenna element.

7. The antenna system of claim 1, wherein the first antenna volume and the second antenna volume are located adjacent to one another on a same side of the body in a portion of the body.

8. The antenna system of claim 1, wherein the second antenna element is further configured to operate at a fourth resonant frequency range that is lower than the first resonant frequency range.

9. The antenna system of claim 1, wherein the second antenna element comprises a dual resonance antenna element and the second antenna volume comprises a wireless local access network coupler for a wireless local access network antenna resonance and a cellular low band coupler for a cellular low band antenna resonance.

10. A mobile device comprising:

a first antenna port, located at a first antenna volume of a body within the mobile device, configured to communicate at a first frequency range in response to a first antenna element coupled thereto;

a second antenna port, located at the first antenna volume of the body or a second antenna volume of the body that is adjacent to the first antenna volume, configured to communicate at a second frequency range that is a subset of the first frequency range in response to a second antenna element coupled thereto;

a third antenna port, located within the first antenna volume, configured to communicate, in response to a third antenna element coupled thereto, at a third frequency range that is a different subset of the first frequency range than the second frequency range that is the subset of the first resonant frequency range; and a coupler located within the first antenna volume and configured to indirectly communicatively couple communication signals to the first antenna port and the third antenna port;

wherein the second antenna port and the first antenna port are further configured to concurrently transmit or receive different communications within the first frequency range.

11. The mobile device of claim 10, wherein the first antenna element, the second antenna element and the third antenna element are configured to concurrently transmit and receive different communications within the first frequency range.

12. The mobile device of claim 11, wherein the different subset of the first frequency range comprises an upper frequency range, and the subset of the first frequency range comprises an adjacent frequency range to the upper frequency range.

13. The mobile device of claim 11, wherein the coupler electromagnetically couples the communication signals to the first antenna port and to the third antenna port.

14. The mobile device of claim 10, further comprising:

a tuning component configured to tune the first antenna port to communicate at a lower frequency range of the first frequency range than the subset and the different subset of the first frequency range.

15. The mobile device of claim 10, wherein the first antenna port communicatively couples a cellular high band antenna element as the first antenna element to the coupler and the second antenna port is communicatively coupled to a wireless local area network antenna element or to a cellular low band network antenna element, as the second antenna element.

16. The mobile device of claim 10, further comprising a transceiver configured to receive or transmit the different communications that is coupled to the coupler via a feed component and to the second antenna.

17. The mobile device of claim 10, wherein the coupler electromagnetically couples the communication signals to the first antenna port and to the second antenna port via an electromagnetic coupling to a feed component and a communication component, the first antenna port further configured to communicate at a cellular high band frequency range and the second antenna port is configured to communicate in a cellular low band frequency range.

* * * * *